US006560833B2

(12) United States Patent
Nishi et al.

(10) Patent No.: US 6,560,833 B2
(45) **Date of Patent: *May 13, 2003**

(54) METHOD OF MANUFACTURING INK JET HEAD

(75) Inventors: Shinichi Nishi, Hino (JP); Katsuaki Komatsu, Hino (JP); Takao Yamaguchi, Hino (JP); Kunihiro Yamauchi, Hino (JP); Yoshio Takeuchi, Hino (JP); Kunio Ito, Hino (JP); Hiroyuki Nomori, Hino (JP); Takemasa Namiki, Hino (JP); Shozo Kikugawa, Hino (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/451,292

(22) Filed: Nov. 30, 1999

(65) Prior Publication Data

US 2003/0011660 A1 Jan. 16, 2003

(30) Foreign Application Priority Data

Dec. 4, 1998 (JP) ..... 10-345816
Dec. 11, 1998 (JP) ..... 10-353307

(51) Int. Cl.[7] ..... H04R 17/00; B21D 53/76

(52) U.S. Cl. ..... 29/25.35; 29/890.1; 29/852; 347/71; 347/72; 310/311; 310/348; 310/359; 156/275.5

(58) Field of Search ..... 29/25.35, 890.1, 29/830, 846, 852; 347/68, 71, 72; 310/328, 348, 357, 359, 311; 156/272.6, 275.5, 275.7; 427/100

(56) References Cited

U.S. PATENT DOCUMENTS 5,320,865 A * 6/1994 Nakahata et al. ..... 427/100
5,351,375 A * 10/1994 Ochiai et al. ..... 29/25.35
5,512,796 A 4/1996 Paton (List continued on next page.)

FOREIGN PATENT DOCUMENTS

EP 0 505 188 A2 9/1992
EP 0 565 280 A2 10/1993
EP 0 650 835 A2 5/1995

(List continued on next page.)

OTHER PUBLICATIONS

Huebner et al, Fabrication of 2–2 Connectivity PZT/Thermoplastic Composites for High Frequency Arrays, Applications of Ferroelectrics, 1994, pp. 206–206, Aug. 1994.*

(List continued on next page.)

*Primary Examiner*—A. Dexter Tugbang
(74) *Attorney, Agent, or Firm*—Frishauf, Holtz, Goodman & Chick, P.C.

(57) ABSTRACT

A method of manufacture an ink jet head in which an ink is jetted from a nozzle hole by applying an electric voltage to an electrode so as to deform ink chambers divided by a partition wall. The method includes the steps of providing plural piezoelectric base plates having polarization side by side on a first non-piezoelectric plate, forming plural grooves for the ink chambers on the piezoelectric base plates and at connecting portions where each edge of the plural piezoelectric base plates provided side by side comes to face other edge; and mounting a second non-piezoelectric base plate on the plural piezoelectric base plates as so to cover the plural grooves so that the ink chambers divided by the partition wall are formed.

10 Claims, 27 Drawing Sheets

U.S. PATENT DOCUMENTS

| | | | | | |
|---|---|---|---|---|---|
| 5,543,009 | A | | 8/1996 | Hayes | |
| 5,548,313 | A | | 8/1996 | Lee | |
| 5,590,451 | A | * | 1/1997 | Katsuumi et al. | 29/25.35 |
| 5,666,145 | A | | 9/1997 | Hayes | |
| 6,103,072 | A | * | 8/2000 | Nishiwaki et al. | 427/100 |

FOREIGN PATENT DOCUMENTS

| | | | | |
|---|---|---|---|---|
| JP | 58-58780 | * | 4/1983 | 310/311 |
| JP | 5-174215 | * | 6/1993 | 29/25.35 |
| JP | 5-318750 | * | 12/1993 | 29/890.1 |
| JP | 6-226973 | | 8/1994 | |
| JP | 10-230600 | | 9/1998 | |

OTHER PUBLICATIONS

Zhang et al, Electrid Field Forced Viragtion of a Periodic Piezocomposite Plate with Laminated and Reflection and Transmission of a Plane Wave at the Fluid–Composite Interface, Ultrasonics Symposium, 1995, IEEE Proceedings, pp 939–944, vol. 2, Nov. 1995.*

* cited by examiner

FIG. 4 ( a )
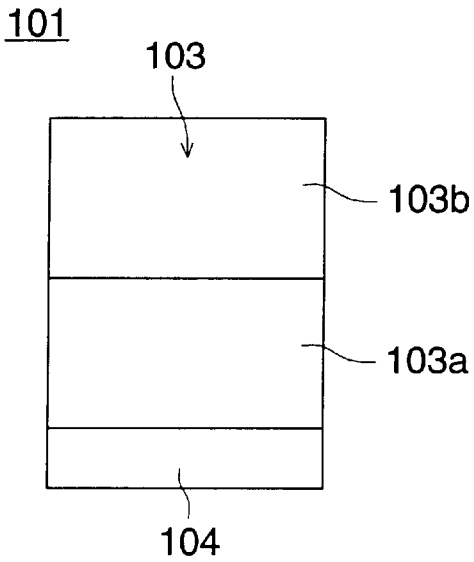
FIG. 4 ( b )
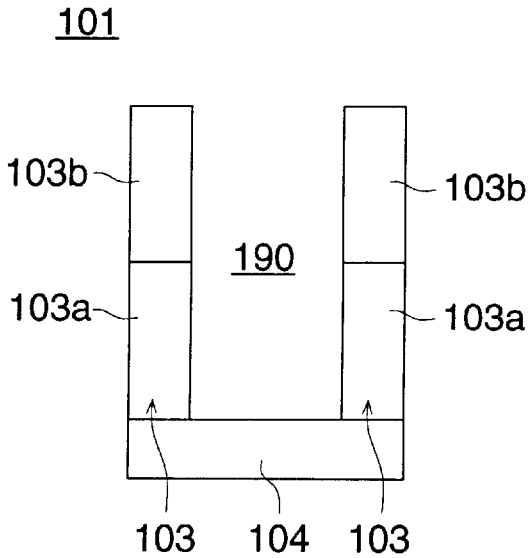
FIG. 4 ( c )
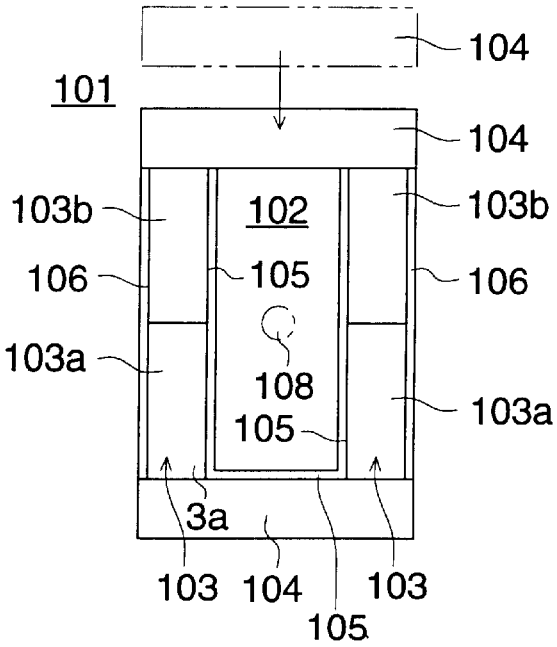

FIG. 8 ( a )
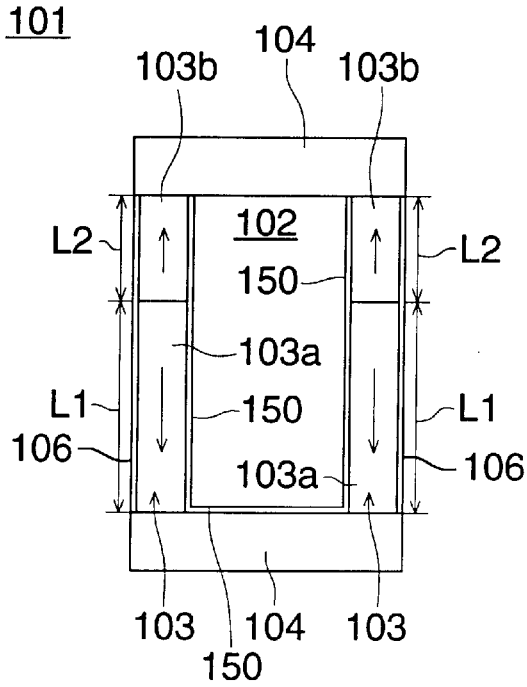
FIG. 8 ( b )
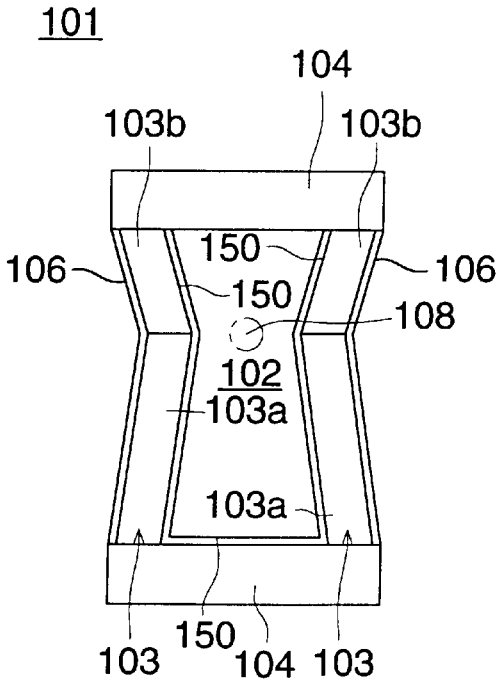

FIG. 15 ( a )
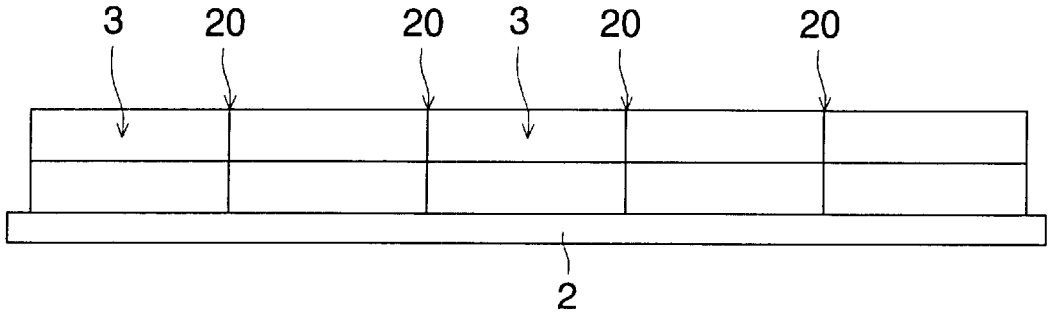
FIG. 15 ( b )
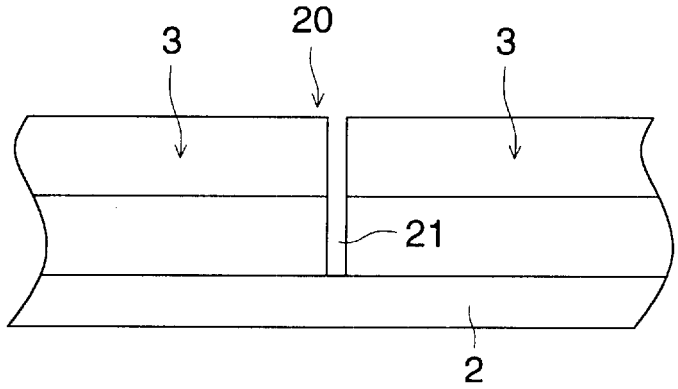
FIG. 15 ( c )
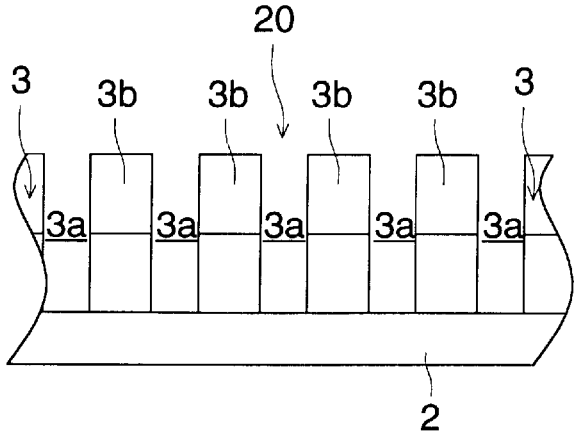

FIG. 19 ( a )
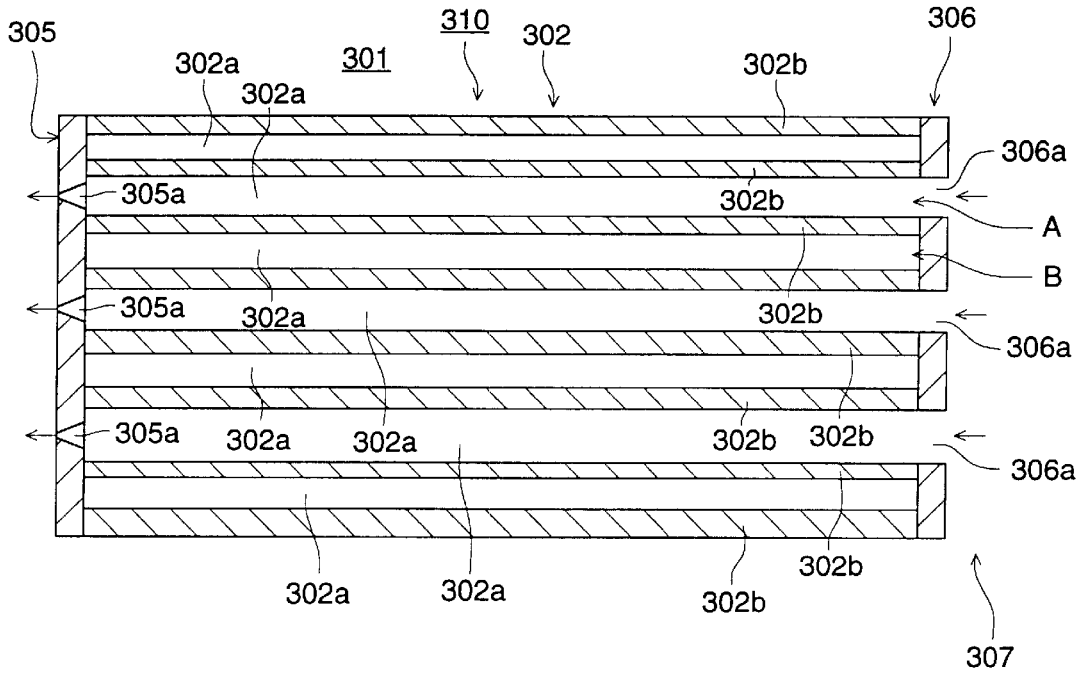
FIG. 19 ( b )
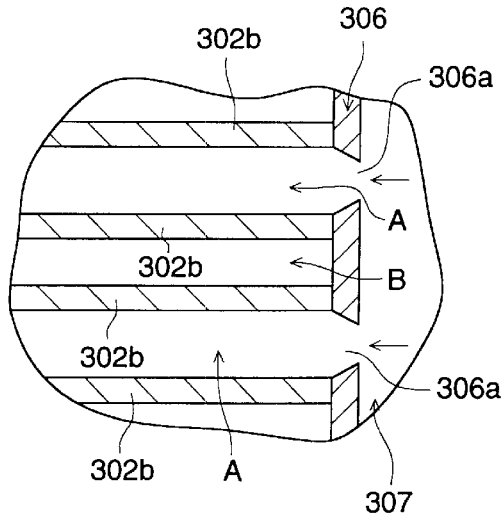

FIG. 22 ( a )
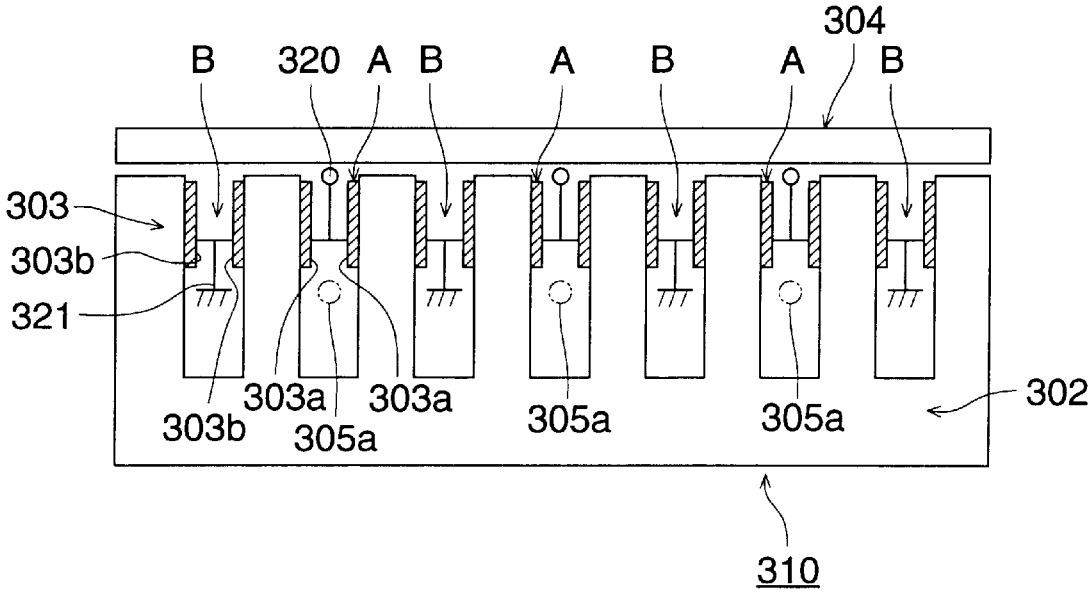
FIG. 22 ( b )
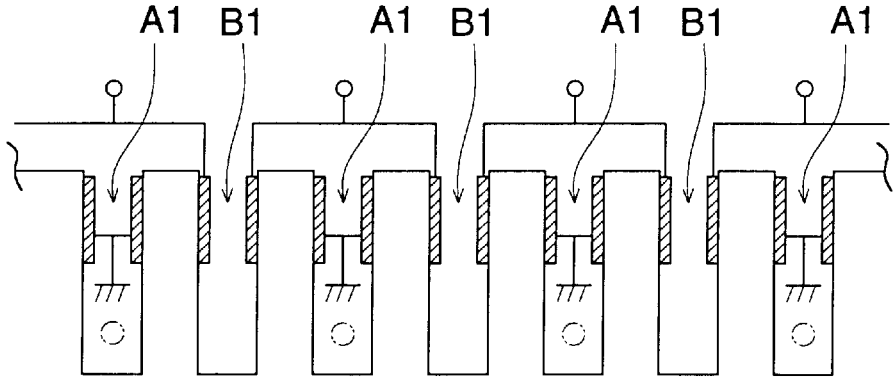

FIG. 23 ( a )
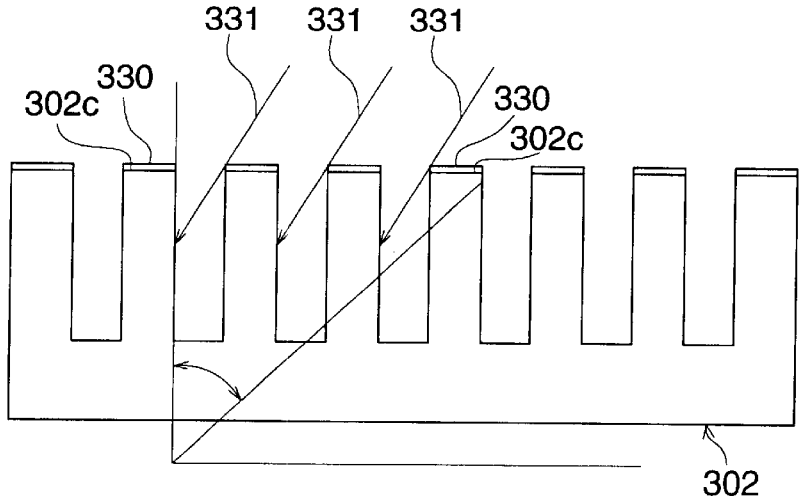
FIG. 23 ( b )
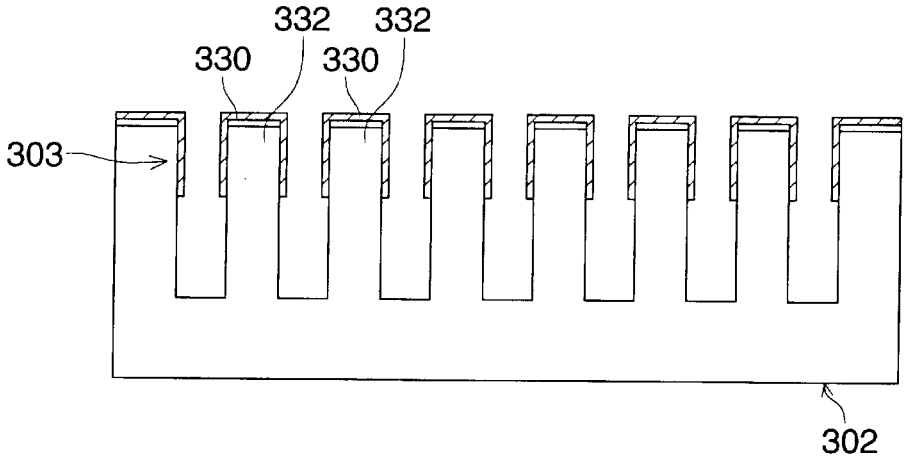
FIG. 23 ( c )
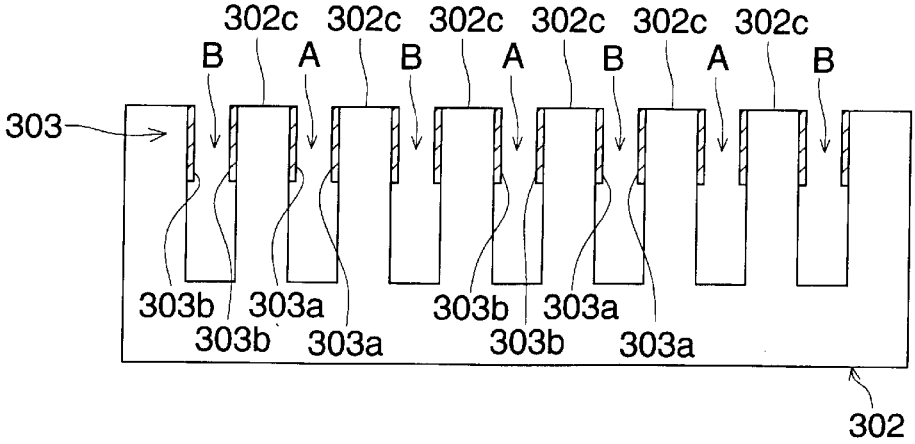

METHOD OF MANUFACTURING INK JET HEAD

BACKGROUND OF THE INVENTION

This invention relates to an ink jet head which jets ink from a nozzle hole by applying an electric voltage to an electrode to deform the shape of the space making up an ink chamber, to a method of manufacturing the ink jet head, to an ink jet printer and to a method of manufacturing the ink jet printer.

There is a letter printing apparatus of the ink jet method which jets ink from a nozzle hole by applying an electric voltage to an electrode to deform the partition wall forming an ink chamber.

If one wishes to carry out image recording of high quality at a high speed using an ink jet head of a conventional type, an ink jet head having a large number of nozzle holes arrayed in a line is required. For such kind of an ink jet head having a large number of nozzles arrayed in a line, from the view point of practical use, it is desired one that has a high driving efficiency, a light weight, a low price, a good workability, and a high strength.

Further, because a polarized piezoelectric ceramic plate has a limit in length for reasons of manufacturing, it has been practiced that a plurality of ink chambers are formed by partition walls in a polarized piezoelectric ceramic plate, and a plurality of such polarized piezoelectric ceramic plates having a plurality of ink chambers are put side by side and bonded by an adhesive; however, in connecting a plurality of polarized piezoelectric plates, it is difficult to adjust the positions of them to keep the intervals between adjacent ink chambers at the connecting portions equal to one another, which makes it difficult to obtain a high-precision ink jet head.

Furthermore, among ink jet heads of the share-mode type which jets ink by deforming the ink chamber, it has been known a chevron type ink jet head which is desirable for carrying out a high-speed and high-quality image recording; however, according to the conventional method of manufacturing the chevron type head, polarized piezoelectric ceramic plates having a plurality of grooves are disposed side by side, and another polarized piezoelectric ceramic plates having a plurality of grooves are superposed and arrayed on them to build an ink jet head having a plurality of ink chambers divided by partition walls; this requires a difficult work of making two piezoelectric plates having mutually coincident positions (of grooves), which makes it difficult to obtain a high-precision ink jet head.

SUMMARY OF THE INVENTION

This invention has been done in view of the above-described points, and it is an object of it to provide an ink jet head and an ink jet printer which is capable of carrying out a high-speed and high-quality image recording and is of low cost and of high precision and a method of manufacturing them.

In order to solve the above-mentioned problems and to accomplish the object, the structure of this invention has been made as follows:

(1) In an ink jet head or an ink jet printer which jets ink from nozzle holes by applying an electric voltage to an electrode to deform the shape of a space forming an ink chamber, the ink chamber is formed by being surrounded by two piezoelectric base plates which are given polarization and face each other and two non-piezoelectric base plates facing each other, and the piezoelectric base plates have a structure such that each of them is made up of at least two lamination layers of a piezoelectric material and the lamination layer surface is approximately parallel to the non-piezoelectric base plates and the polarizing directions of these two lamination layers of the piezoelectric material are opposite to each other, and an electrode is provided on the surface of each of the piezoelectric base plates and the non-piezoelectric base plates facing the ink chamber.

According to the structure (1), since the ink jet head is constructed such that the ink chamber is formed by being surrounded by two piezoelectric base plates which are given polarization and face each other and two non-piezoelectric base plates facing each other, and the piezoelectric base plates have a structure such that each of them is made up of at least two lamination layers of a piezoelectric material and the lamination layer surface is approximately parallel to the non-piezoelectric base plates and the polarizing directions of these two lamination layers of the piezoelectric material are opposite to each other, and an electrode is provided on the surface of each of the piezoelectric base plates and the non-piezoelectric base plates facing the ink chamber; in comparison with the case that an electrode is provided only to the piezoelectric base plates without being provided to the non-piezoelectric base plates, the work to provide the electrode is easy so that the ink jet head is of low cost and capable of driving the piezoelectric base plates at a low voltage, has a high-efficiency driving performance owing to a large amount of deformation in the piezoelectric base plates, is capable of coping with multiple nozzles, has the capability of high-frequency driving, and jets small droplets with multi-gradation so that an image recording can be conducted at a high-speed with high-quality image.

(2) The ink jet head or the ink jet printer described in (1), wherein an electrode is provided on the ink chamber facing surface of each of the piezoelectric base plates which are given polarization and face each other and on the ink chamber facing surface of either one of the non-piezoelectric base plates facing each other.

According to this structure (2), since an electrode is provided on the ink chamber facing surface of each of the piezoelectric base plates which are given polarization and face each other and on the ink chamber facing surface of either one of the non-piezoelectric base plates facing each other, in comparison with the case that an electrode is provided only to the piezoelectric base plates without being provided to the non-piezoelectric base plates, the work to provide the electrode is easy so that the ink jet head is of low cost and capable of driving the piezoelectric base plates at a low voltage, has a high-efficiency driving performance owing to a large amount of deformation in the piezoelectric base plates, is capable of coping with multiple nozzles, has the capability of high-frequency driving, and jets small droplets with multi-gradation so that an image recording can be conducted at a high-speed with high-quality image.

(3) The ink jet head or the ink jet printer described in (1) or (2), wherein the ink chamber is formed in multi-stages.

According to this structure (3), since the ink chamber is formed in multi-stages, it can carry out a more high-speed and high-quality image recording and can improve resolution of the image with multiple nozzles of the multi-stage ink chamber.

(4) The ink jet head or the ink jet printer described in (1) or (3), wherein the piezoelectric base plates are shaped in a flat surface or a curved surface.

(5) The ink jet head or the ink jet printer described in (1) or (4), wherein the piezoelectric base plates have at least two lamination layers which have different lengths in the layer laminating direction.

According to this structure (5), because the piezoelectric base plates have at least two layers which have different lengths in the layer laminating direction, the shape of the space making up the ink chamber can be deformed in a manner corresponding to the position of a nozzle hole, and ink can be jetted from the nozzle hole more efficiently.

(6) The ink jet head or the ink jet printer described in (1) or (5), wherein the piezoelectric base plates have at least one layer made of a non-piezoelectric material.

According to this structure (6), because the piezoelectric base plates have at least one layer made of a non-piezoelectric material, ink can be jetted from a nozzle hole efficiently by deforming the shape of the space making up the ink chamber variously.

(7) In an ink jet head or the ink jet printer which jets ink from nozzle holes by applying an electric voltage to an electrode to deform an ink chamber which is partitioned by partition walls, a plurality of piezoelectric base plates which are given polarization are disposed side by side on a non-piezoelectric base plate, a plurality of grooves are provided in each of the piezoelectric base plates, and another non-piezoelectric base plate is provided on these piezoelectric base plate so that a plurality of ink chambers partitioned by partition walls are provided.

According to this structure (7), since a plurality of piezoelectric base plates which are given polarization are disposed side by side on a non-piezoelectric base plate, a plurality of grooves are provided in each of the piezoelectric base plates, and another non-piezoelectric base plate is provided on these piezoelectric base plate so that a plurality of ink chambers partitioned by partition walls are provided, an ink chamber can be formed without lowering positional precision and it is possible to obtain a long-sized line head which is of low cost, has a high precision, and is long in its lengthwise direction; thus, a high-speed and high-quality image recording can be carried out.

(8) The ink jet head or the ink jet printer described in (7), wherein the grooves are formed at the connecting portions of the plurality of piezoelectric base plates.

According to this structure (8), because grooves are formed at the connecting portions of the plurality of piezoelectric base plates, the positional precision of the ink chamber can be improved further more.

(9) In an ink jet head or the ink jet printer which jets ink from nozzle holes by applying an electric voltage to an electrode to deform an ink chamber which is partitioned by partition walls, a piezoelectric base plate comprising at least two layers of piezoelectric material whose polarizing directions are opposite to each other are disposed on a non-piezoelectric base plate, a plurality of grooves are provided with a predetermined interval in each of the piezoelectric base plates, and another non-piezoelectric base plate is provided on these piezoelectric base plate so that a plurality of ink chambers partitioned by partition walls are provided.

According to this structure (9), since a piezoelectric base plate comprising at least two layers of piezoelectric material whose polarizing directions are opposite to each other are disposed on a non-piezoelectric base plate, a plurality of grooves are provided with a predetermined interval in each of the piezoelectric base plates, and another non-piezoelectric base plate is provided on these piezoelectric base plate so that a plurality of ink chambers partitioned by partition walls are provided, the ink chambers are formed in the piezoelectric base plates without the deviation of grooves, it is possible to obtain a low-cost and high-precision line head, and a high-speed and high-quality image recording can be carried out.

(10) The ink jet head or the ink jet printer described in (9), wherein grooves are formed at the connecting portions of the plurality of piezoelectric base plates.

According to this structure (10), because grooves are formed at the connecting portions of the plurality of piezoelectric base plates, ink chambers are formed without lowering of the positional precision more reliably.

(11) The ink jet head or the ink jet printer described in one of (1) through (10), wherein the piezoelectric base plates is made of a non-metallic material.

According to this structure (11), since the piezoelectric base plates is made of a non-metallic material, the partition walls of the ink chamber can be deformed more reliably.

(12) The ink jet head or the ink jet printer described in one of (1) through (10), wherein the material of the non-metallic material is at least one selected from alumina, aluminum nitride, zirconia, silicon, silicon nitride, silicon carbide, and quartz.

According to this structure (12), since the material of the non-metallic material is at least one selected from alumina, aluminum nitride, zirconia, silicon, silicon nitride, silicon carbide, and quartz, the piezoelectric base plates can be reliably supported even if the partition walls of an ink chamber are deformed.

(13) The ink jet head or the ink jet printer described in one of (7) through (12), wherein a surface roughness of the bonded surfaces between the non-piezoelectric base plate and the piezoelectric base plates is not larger than 1.0 $\mu$m.

According to this structure (14), since a surface roughness of the bonded surfaces between the non-piezoelectric base plate and the piezoelectric base plates is not larger than 1.0 $\mu$m, it is possible to prevent a soft high molecular adhesive (for example, epoxy resin) from entering into the concave portions on the bonded surfaces, the film thickness of the adhesive is practically limited to a minimum, and it is possible to avoid the lowering of sensitivity and the rise of the electric voltage owing to the lowering of the driving force of the piezoelectric base plates.

(14) The ink jet head or the ink jet printer described in one of (9) through (13), wherein a surface roughness of the bonded surfaces between piezoelectric materials of the piezoelectric base plates having at least two layers of the piezoelectric materials is not larger than 1.0 $\mu$m.

According to this structure (14), since a surface roughness of the bonded surfaces between piezoelectric materials of the piezoelectric base plates having at least two layers of the piezoelectric materials is not larger than 1.0 $\mu$m, it is possible to prevent a soft high molecular adhesive (for example, epoxy resin) from entering into the concave portions on the bonded surfaces, the film thickness of the adhesive is practically limited to a minimum, and it is possible to avoid the lowering of sensitivity and the rise of the electric voltage owing to the lowering of the driving force of the piezoelectric base plates.

(15) The ink jet head or the ink jet printer described in one of (7) through (14), wherein the bonded surfaces between the non-piezoelectric base plate and the piezoelectric base plates are subjected to a plasma treatment or a U.V. treatment.

According to this structure (15), since the bonded surfaces between the non-piezoelectric base plate and the piezoelectric base plates are subjected to plasma treatment or UV treatment, organic contaminants can be cleaned and removed and wetting ability of the surfaces for the adhesive is improved over the whole surface to eliminate poor bonding such as minute bubble remains, and owing to it, poor driving for the piezoelectric base plates can be eliminated.

(16) The ink jet head or the ink jet printer described in one of (8) through (14), wherein the bonded surfaces between piezoelectric material layers of the piezoelectric base plates having at least two layers of the piezoelectric material are subjected to plasma treatment or UV treatment.

According to this structure (16), since the bonded surfaces between piezoelectric material layers of the piezoelectric base plates having at least two layers of the piezoelectric material are subjected to plasma treatment or UV treatment, organic contaminants can be cleaned and removed and wetting ability of the surfaces for the adhesive is improved over the whole surface to eliminate poor bonding such as minute bubble remains, and owing to it, poor driving for the piezoelectric base plates can be eliminated.

(17) A method of manufacturing an ink jet head or an ink jet head printer which jets ink from nozzle holes by applying an electric voltage to an electrode to deform a shape of a space forming an ink chamber, comprising steps of forming the ink chamber by surrounding by two piezoelectric base plates which are given polarization and face each other and two non-piezoelectric base plates facing each other and providing an electrode on each of the piezoelectric base plates, wherein the piezoelectric base plates have a structure such that each of them is made up of at least two layers of piezoelectric material, the layer surfaces are approximately parallel to the non-piezoelectric base plates and the polarizing directions of these two adjacent layers made of piezoelectric material are opposite to each other.

According to this method (17), since the ink chamber is formed by surrounding by two piezoelectric base plates which are given polarization and face each other and two non-piezoelectric base plates facing each other, an electrode is provided on each of the piezoelectric base plates, and the piezoelectric base plates have a structure such that each of them is made up of at least two layers of piezoelectric material, the layer surfaces are approximately parallel to the non-piezoelectric base plates and the polarizing directions of these two adjacent layers made of piezoelectric material are opposite to each other, it can be manufactured an ink jet head which is of low cost, can drive the piezoelectric base plates at a low voltage, has a high-efficiency driving performance owing to a large amount of deformation in the piezoelectric base plates, is capable of coping with multiple nozzles, has the capability of high-frequency driving, can jet small droplets with multi-gradation so that an image recording can be conducted at a high-speed with high-quality image.

(18) The method of manufacturing an ink jet head or an ink jet printer described in (17), wherein the ink chamber is formed by pasting the piezoelectric base plate composed of at least two layers on the non-piezoelectric base plate, machining the pasted piezoelectric base plate so as to provide grooves, and pasting another non-piezoelectric base plate onto the piezoelectric base plate.

According to this method (18), since the ink chamber is formed by pasting the piezoelectric base plate composed of at least two layers on the non-piezoelectric base plate, machining the pasted piezoelectric base plate so as to provide grooves, and pasting another non-piezoelectric base plate onto the piezoelectric base plate, an ink chamber can be formed at a low cost and with a high precision owing to the ease of the positional adjustment of the ink chamber.

(19) The method of manufacturing an ink jet head or an ink jet described in (17), wherein the ink chamber is formed by pasting the piezoelectric base plate, which has been machined to have a groove, on the non-piezoelectric base plate, and pasting another non-piezoelectric base plate onto the piezoelectric base plate.

According to this method (19), since the ink chamber is formed by pasting the piezoelectric base plate, which has been machined to have a groove, on the non-piezoelectric base plate, and pasting another non-piezoelectric base plate onto the piezoelectric base plate, an ink chamber can be formed at a low cost and with a high precision owing to the ease of the positional adjustment of the ink chamber.

(20) The method of manufacturing an ink jet head or an ink jet described in one of (17) to (19), further comprising a step of providing an electrode on the non-piezoelectric base plate.

According to this method (21), by providing an electrode on the non-piezoelectric base plate, the electrical connection to an electrode on the piezoelectric base plates can be carried out through the electrode on the non-piezoelectric base plate, the electrical connection with the external power source can be done easily and the efficiency of operation is also improved.

(21) The method of manufacturing an ink jet head or an ink jet described in one of (17) to (20), wherein the ink chamber is formed in multi-stages.

According to this method (21), since the ink chamber is formed in multi-stages, it can carry out a more high-speed and high-quality image recording and can improve resolution of the image with multiple nozzles of the multi-stage ink chamber.

(22) The method of manufacturing an ink jet head or an ink jet described in one of (17) to (21), wherein the piezoelectric base plates are shaped in a flat surface or a curved surface.

According to this method (22), the ink jet head is of low cost owing to the flat surface piezoelectric base plates, or since the amount of deformation of the space forming the ink chamber can be made large by the curved surface, a high-quality image recording can be conducted at a high-speed.

(23) The method of manufacturing an ink jet head or an ink jet described in one of (17) to (22), wherein the piezoelectric base plates have at least two lamination layers which have different lengths in the layer laminating direction.

According to this method (23), because the piezoelectric base plates have at least two layers which have different lengths in the layer laminating direction, the shape of the space making up the ink chamber can be deformed in a manner corresponding to the position of a nozzle hole, and ink can be jetted from the nozzle hole more efficiently.

(24) The method of manufacturing an ink jet head or an ink jet described in one of (17) to (23), wherein the piezoelectric base plates have at least one layer made of a non-piezoelectric material.

According to this method (24), because the piezoelectric base plates have at least one layer made of a non-piezoelectric material, ink can be jetted from a nozzle hole efficiently by deforming the shape of the space making up the ink chamber variously.

(25) A method of manufacturing an ink jet head or an ink jet which jets ink from nozzle holes by applying an electric voltage to an electrode to deform an ink chamber partitioned by partition walls, comprising steps by providing a plurality of piezoelectric base plates which have been given polarization side by side on a non-piezoelectric base plate, machining the piezoelectric base plate so as to form grooves, and thereafter providing another non-piezoelectric base plate on the piezoelectric base plates so that a plurality of ink chambers which are partitioned by partition walls are provided.

According to this method (25), since a plurality of piezoelectric base plates which have been given polarization are provided side by side on a non-piezoelectric base plate, the piezoelectric base plate is machined so as to form grooves, and thereafter another non-piezoelectric base plate is provided on the piezoelectric base plates so that a plurality of ink chambers which are partitioned by partition walls are provided, ink chambers can be formed without lowering positional precision; hence, a high-precision long-sized line head can be obtained at a low cost.

(26) The method of manufacturing an ink jet head or an ink jet described in (25), wherein the grooves are formed at the connecting portions of the plurality of piezoelectric base plates.

According to this structure (26), because the grooves are formed at the connecting portions of the plurality of piezoelectric base plates, the positional precision of the ink chamber can be improved further more.

(27) A method of manufacturing an ink jet head or an ink jet which jets ink from nozzle holes by applying an electric voltage to an electrode to deform an ink chamber partitioned by partition walls, comprising steps by laminating a piezoelectric base plate comprising at least two layers of a piezoelectric material which have different polarizing directions opposite to each other on a non-piezoelectric base plate, machining the piezoelectric base plate so as to form grooves, and thereafter providing another non-piezoelectric base plate on the piezoelectric base plates so that a plurality of ink chambers which are partitioned by partition walls are provided.

According to this method (27), since a piezoelectric base plate comprising at least two layers of a piezoelectric material which have different polarizing directions opposite to each other is laminated on a non-piezoelectric base plate, the piezoelectric base plate is machined so as to form grooves, and thereafter another non-piezoelectric base plate is provided on the piezoelectric base plates so that a plurality of ink chambers which are partitioned by partition walls are provided, ink chambers can be formed without deviation of grooves in the piezoelectric base plates, a high-precision line head can be obtained at a low cost.

(28) A method of manufacturing an ink jet head or an ink jet which jets ink from nozzle holes by applying an electric voltage to an electrode to deform an ink chamber partitioned by partition walls, comprising steps by laminating a piezoelectric base plate comprising at least two layers of a piezoelectric material which have different polarizing directions opposite to each other on a non-piezoelectric base plate, machining the piezoelectric base plate so as to form grooves, and thereafter providing another non-piezoelectric base plate on the piezoelectric base plates so that a plurality of ink chambers which are partitioned by partition walls are provided.

According to this method (28), since a piezoelectric base plate comprising at least two layers of a piezoelectric material which have different polarizing directions opposite to each other is laminated on a non-piezoelectric base plate, the piezoelectric base plate is machined so as to form grooves, and thereafter another non-piezoelectric base plate is provided on the piezoelectric base plates so that a plurality of ink chambers which are partitioned by partition walls are provided, ink chambers can be formed without deviation of grooves in the piezoelectric base plates, a high-precision long-sized line head can be obtained at a low cost.

(29) The method of manufacturing an ink jet head or an ink jet described in (28), wherein the grooves are formed at the connecting portions of the piezoelectric base plates.

According to this method (29), because the grooves are formed at the connecting portions of the plurality of piezoelectric base plates, the ink jet head in which the positional precision of the ink chamber can be improved further more, can be manufactured.

(30) The method of manufacturing an ink jet head or an ink jet described in one of (17) through (29), wherein the piezoelectric base plates is made of a non-metallic material.

According to this method (30), since the piezoelectric base plates is made of a non-metallic material, the ink jet head in which the partition walls of the ink chamber can be deformed more reliably, can be manufactured.

(31) The method of producing an ink jet head or an ink jet described in one of (17) through (29), wherein the material of the non-metallic material is at least one selected from alumina, aluminum nitride, zirconia, silicon, silicon nitride, silicon carbide, and quartz.

According to this method (12), since the material of the non-metallic material is at least one selected from alumina, aluminum nitride, zirconia, silicon, silicon nitride, silicon carbide, and quartz, the ink jet head in which the piezoelectric base plates can be reliably supported even if the partition walls of an ink chamber are deformed, can be manufactured.

(32) The method of producing an ink jet head or an ink jet described in one of (17) through (31), wherein a surface roughness of the bonded surfaces between the non-piezoelectric base plate and the piezoelectric base plates is not larger than 1.0 $\mu$m.

According to this method (32), since a surface roughness of the bonded surfaces between the non-piezoelectric base plate and the piezoelectric base plates is not larger than 1.0 $\mu$m, the ink jet head in which it is possible to prevent a soft high molecular adhesive (for example, epoxy resin) from entering into the concave portions on the bonded surfaces, the film thickness of the adhesive is practically limited to a minimum, and it is possible to avoid the lowering of sensitivity and the rise of the electric voltage owing to the lowering of the driving force of the piezoelectric base plates, can be manufactured.

(33) The method of producing an ink jet head or an ink jet described in one of (17) through (31), wherein a surface roughness of the bonded surfaces between piezoelectric materials of the piezoelectric base plates having at least two layers of the piezoelectric materials is not larger than 1.0 $\mu$m.

According to this method (33), since a surface roughness of the bonded surfaces between piezoelectric materials of the piezoelectric base plates having at least two layers of the piezoelectric materials is not larger than 1.0 $\mu$m, the ink jet head in which it is possible to prevent a soft high molecular adhesive (for example, epoxy resin) from entering into the concave portions on the bonded surfaces, the film thickness of the adhesive is practically limited to a minimum, and it is possible to avoid the lowering of sensitivity and the rise of the electric voltage owing to the lowering of the driving force of the piezoelectric base plates, can be manufactured.

(34) The method of producing an ink jet head or an ink jet described in one of (17) through (33), wherein the bonded surfaces between the non-piezoelectric base plate and the piezoelectric base plates are subjected to plasma treatment or UV treatment.

According to this method (34), since the bonded surfaces between the non-piezoelectric base plate and the piezoelectric base plates are subjected to plasma treatment or UV treatment, the ink jet head in which organic contaminants can be cleaned and removed and wetting ability of the surfaces for the adhesive is improved over the whole surface to eliminate poor bonding such as minute bubble remains, and owing to it, poor driving for the piezoelectric base plates can be eliminated, can be manufactured.

(35) The method of producing an ink jet head or an ink jet described in one of (17) through (33), wherein the bonded surfaces between piezoelectric material layers of the piezoelectric base plates having at least two layers of the piezoelectric material are subjected to plasma treatment or UV treatment.

According to this structure (35), since the bonded surfaces between piezoelectric material layers of the piezoelectric base plates having at least two layers of the piezoelectric material are subjected to plasma treatment or UV treatment, the ink jet head in which organic contaminants can be cleaned and removed and wetting ability of the surfaces for the adhesive is improved over the whole surface to eliminate poor bonding such as minute bubble remains, and owing to it, poor driving for the piezoelectric base plates can be eliminated, can be manufactured.

BRIEF DESCRIPTION OF THE DRAWINGS

FIGS. 4(*a*) to 4(*c*) are drawings showing the manufacture process of an ink jet head of the chevron type;

FIGS. 8(*a*) and 8(*b*) are the front view of an ink jet head of the chevron type in another embodiment;

FIGS. 15(*a*) to 15(*c*) are drawings showing the manufacturing process of an ink jet head.

FIGS. 19(*a*) and 19(*b*) are lateral sectional view of an ink jet head.

FIGS. 22(*a*) and 22(*b*) are sectional views of an ink jet head.

FIGS. 23(*a*) to 23(*c*) are diagrams showing how an electrode of an ink jet head is formed.

DETAILED DESCRIPTION OF THE PREFERRED EMBODIMENT

In the following, the ink jet head, the ink jet printer and the method of manufacturing of the ink jet head and the ink jet printer of this invention will be explained with reference to the embodiments; however, the mode of this invention should not be limited to the embodiment.

Figure 1:
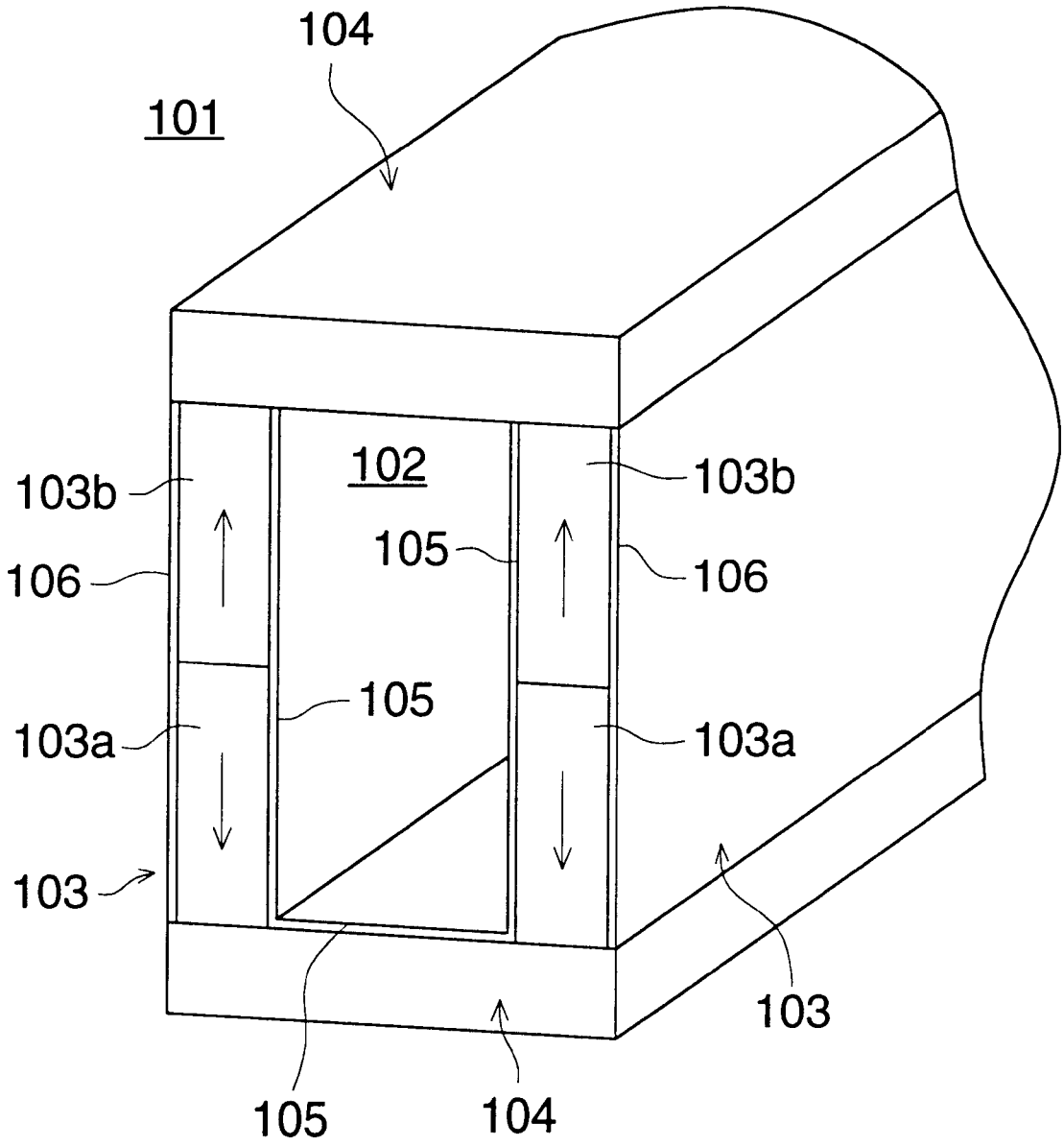
FIG. 1 is a perspective view of an ink jet head of the chevron type.
Figure 2:
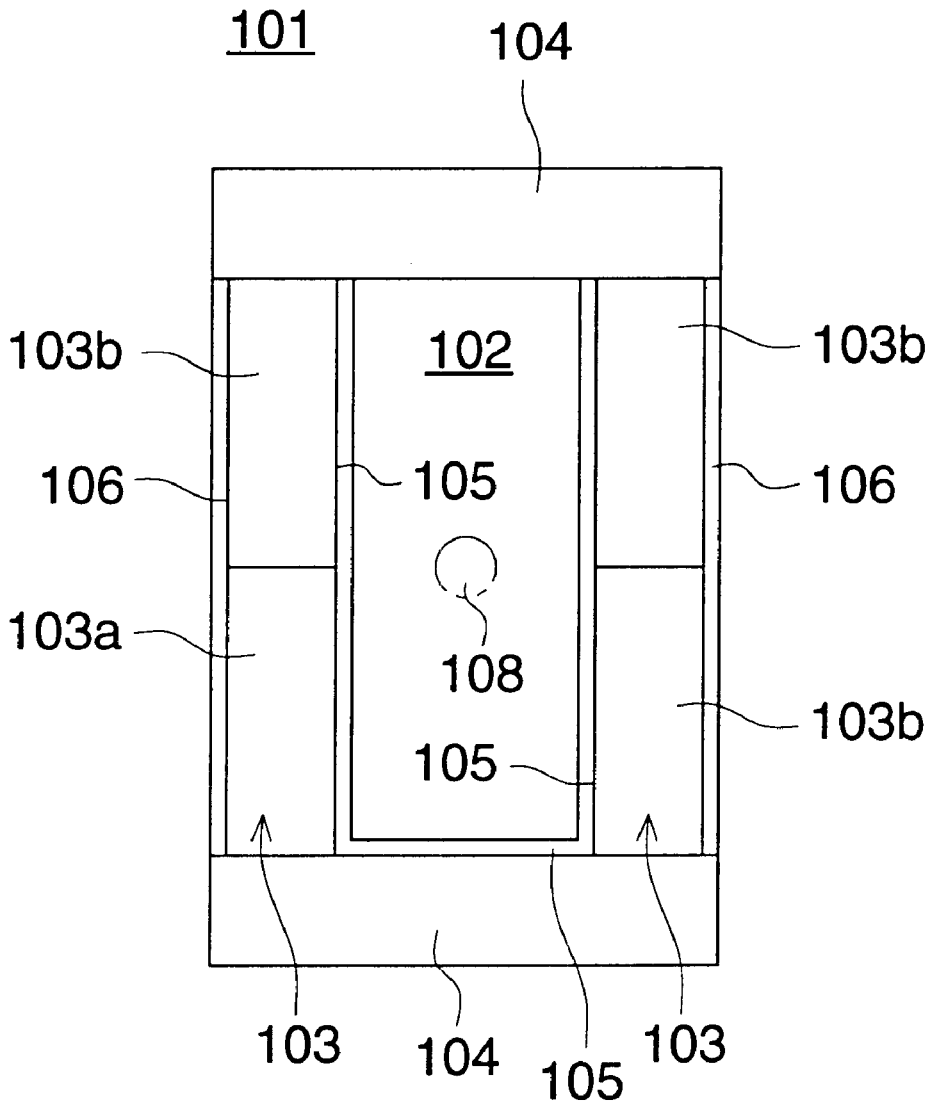
FIG. 2 is the front view of an ink jet head of the chevron type.
Figure 3:
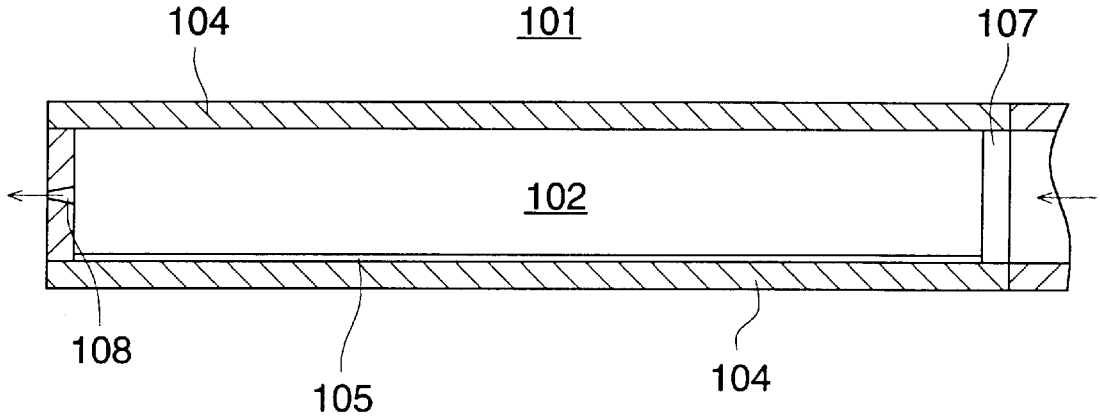
FIG. 3 is a cross-sectional view of an ink jet head of the chevron type.

FIG. 1 to FIG. 11 show an ink jet head; FIG. 1 is a perspective view, FIG. 2 is the front view, and FIG. 3 is a cross-sectional view.

An ink jet head 101 of this embodiment jets ink from nozzle hole 108 by applying an electric voltage to the electrode to deform the shape of the space making up the ink chamber 102. In this ink jet head 101, the ink chamber 102 is formed by being surrounded by the two piezoelectric base plates 103 which have been given polarization and face each other and the two non-piezoelectric base plates 104 facing each other otherwise. On both inner and outer surfaces of each of these piezoelectric base plates 103, electrodes 105 and 106 are provided respectively; these piezoelectric base plates 103 have a structure such that each of them is composed of two layers of piezoelectric material 103*a* and 103*b*, the border surface between the layers is approximately parallel to the non-piezoelectric base plates 104, and the directions of polarization of these layers made of a piezoelectric material 103*a* and 103*b* are opposite to each other. The direction of polarization is, generally speaking, the direction in which a material polarizes when an electric field is applied to it, and the direction of polarization of a piezoelectric material is determined when it has been polarized by applying to it polarization processing beforehand. The piezoelectric base plates 103, 103 are formed by pasting two layers 103*a*, 103*b*. As a method of pasting, gluing (thermally hardening, thermoplastic, thermally U.V. hardening), melting, layer forming may be employed.

Electrodes 105, 106 are provided on both obverse and reverse surfaces of the piezoelectric base plates 103, 103. On other hand, electrode 105 is provided on an inner surface of a non-piezoelectric base plate. The electrodes 105 and 106 are provided on the piezoelectric base plates 103 by vacuum deposition, sputtering, plating, or others. By vacuum deposition and sputtering, they can be formed in high purity and to a high-function film; by plating, they can be formed at a low cost and on detailed minute portions. For the metal to be made the electrodes, gold, silver, aluminum, palladium, nickel, tantalum, and titanium can be used, and in particular, from the view points of electrical property and workability, gold and aluminum is desirable; the electrodes are formed by plating, vapor deposition, or sputtering.

Further, an electrode can be provided also on one of the non-piezoelectric base plates 104; owing to this, the electrical connection to the electrodes 105 and 106 on the piezoelectric base plates 103 can be made through the electrode(s) on the plate(s) of non-piezoelectric material, which makes the electrical connection to the external power source easy, and improves the efficiency of operation. Incidentally, an electrode may be provided on another non-piezoelectric base plate 104 opposite to the one of the non-piezoelectric base plates 104.

In this ink jet head 101, as shown in FIG. 3, ink is supplied to the ink chamber 102 through the ink supply opening 107, which is formed at the position opposite to the nozzle hole 108.

In this manner, since the ink chamber 102 is formed by being surrounded by two piezoelectric base plates 103, 103 which are given polarization and face each other and two non-piezoelectric base plates 104, 104 facing each other, and the piezoelectric base plates 103, 103 have a structure such that each of them is made up of at least two lamination layers 103*a*, 103*b* of a piezoelectric material and the lamination layer surface is approximately parallel to the non-piezoelectric base plates 104, 104 and the polarizing directions of these two lamination layers 103*a*, 103*b* of the piezoelectric material are opposite to each other, and an electrode 105 is provided on the surface of each of the piezoelectric base plates 103, 103 and the one of the non-piezoelectric base plates 104 facing the ink chamber 102; in comparison with the case that an electrode is provided only to the piezoelectric base plates 103, 103 without being provided to the non-piezoelectric base plates 104, the work to provide the electrode 105 is easy so that the ink jet head is of low cost and capable of driving the piezoelectric base plates 103, 103 at a low voltage, has a high-efficiency driving performance owing to a large amount of deformation in the piezoelectric base plates 103, 103, is capable of coping with multiple nozzles, has the capability of high-frequency driving, and jets small droplets with multi-gradation so that an image recording can be conducted at a high-speed with high-quality image.

As shown in FIG. 4, this ink chamber 102 is formed by sticking the plate 103 having at least two layers of piezoelectric material 103*a* and 103*b* on the non-piezoelectric base plate 104 (FIG. 4(*a*)), working the piezoelectric base plate 103 which has been stuck to provide a groove (FIG. 4(*b*)), and sticking the upper non-piezoelectric base plate 104 onto this piezoelectric base plate which has been worked to provide a groove (FIG. 4*c*). On each surface of the piezoelectric base plate 103 and the non-piezoelectric base plate 104 which faces the ink chamber 120, there is provided an electrode 105 before another non-piezoelectric base plate 104 is pasted.

In this way, by sticking the piezoelectric base plate 103 composed of at least two layers 103*a* and 103*b* on the non-piezoelectric base plate 104, and working it to provide a groove after sticking together, the ink chamber 102 can be formed at a low cost and with a high precision owing to the ease of positional adjustment of the ink chamber.

In the manufacturing of the ink jet head of this invention, the ink chamber 102 is formed by providing a groove in the piezoelectric base plate 103 after it is put superposed on the non-piezoelectric base plate 104; however, in providing this groove, it is appropriate to make the groove in a manner such that the non-piezoelectric base plate 104 is exposed, or it is also appropriate to form the groove in a manner such that a part of the piezoelectric base plate 103 is left on the non-piezoelectric base plate 104.

Figure 5:
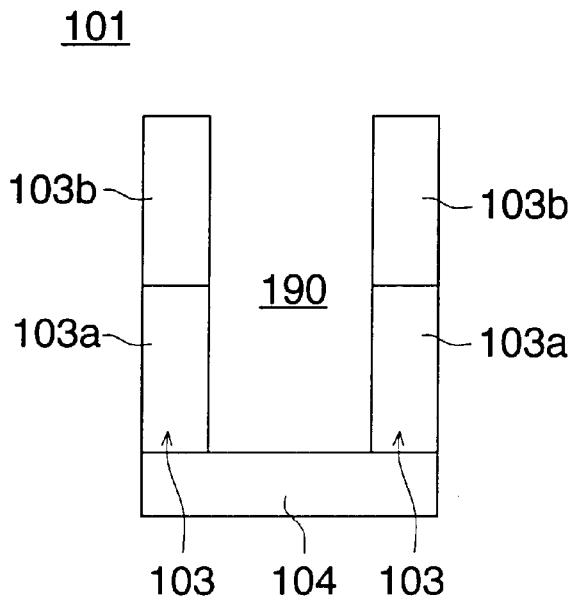
FIGS. 5(*a*) and 5(*b*) are drawing showing the manufacture process of an ink jet head of the chevron type in another embodiment.
Figure 5:
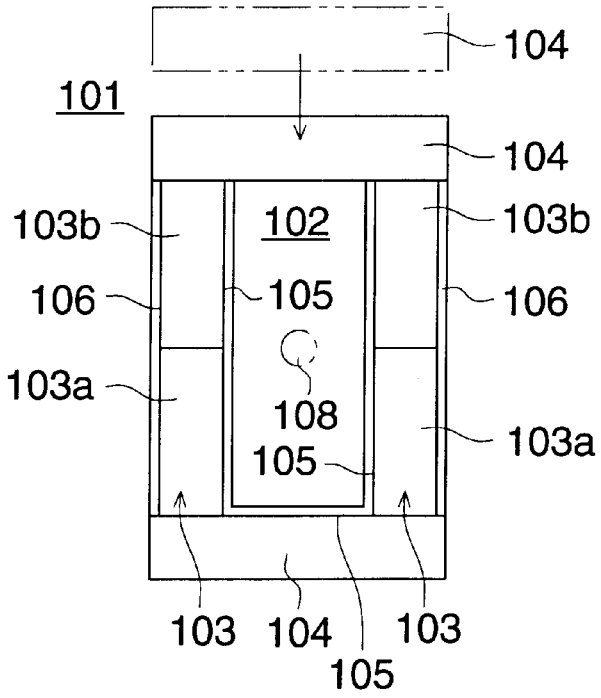

Further, as shown in FIG. 5, the ink chamber 102 can be formed by sticking the piezoelectric base plate 103 having at least two layers of piezoelectric material 103*a* and 103*b* and the slit 103*c* on the non-piezoelectric base plate 104 (FIG. 5(*a*)), and sticking another non-piezoelectric base plate 104 after sticking the plate 103 (FIG. 5(*b*)).

In this way, by sticking together the lower non-piezoelectric base plate 104, the piezoelectric base plate 103 having at least two layers of piezoelectric material 103*a* and 103*b* and the slit 103*c*, and the another non-piezoelectric base plate 104 successively, the ink chamber can be formed at a low cost and the efficiency of assembling is high. In this embodiment, on each surface of the piezoelectric base plate 103 and the non-piezoelectric base plate 104 which faces the ink chamber 120, there is provided an electrode 105 before another non-piezoelectric base plate 104 is pasted.

Figure 6:
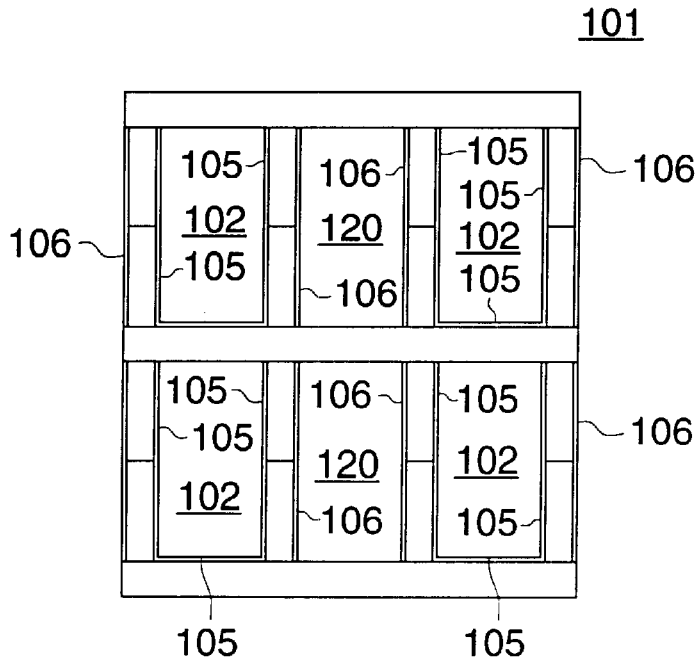
FIGS. 6(*a*) and 6(*b*) are the front view of an ink jet head of the chevron type in another embodiment.
Figure 6:
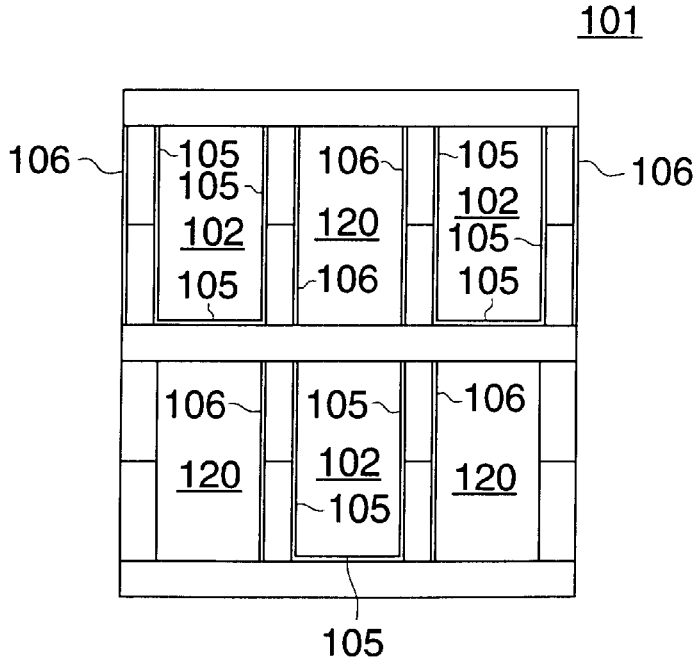

Further, as shown in FIG. 6, the ink jet head 101 can have the ink chamber 102 formed in multiple stages, by which it is made to have multiple nozzles, and it can carry out a high-speed and high-quality image recording and improve the resolution of the image. In the embodiment in FIG. 6(*a*), in the first stage, the ink chambers 102 are formed at the both sides of the air chamber 120; in the second stage too, the ink chambers 102 are formed at the both sides of the air chamber 120 in the same way, that is, the ink chambers are formed at the corresponding positions.

In the embodiment in FIG. 6(*b*), in the first stage, the ink chamber 102 is formed between the air chambers 120; in the second stage, the ink chambers are formed at the both sides of the air chamber 120, that is, the ink chambers are formed at the positions corresponding to those of the air chambers 120 in the first stage, which improves the resolution of image higher.

The air chamber 120 is a chamber which is separated from the ink chamber and no ink enters in; in the case where the ink chambers are provided at the both sides of it, the partition walls of the both sides can be driven independently to make it possible for the ink chambers at the both sides to jet ink, which makes it possible to cope with high-speed driving.

Figure 7:
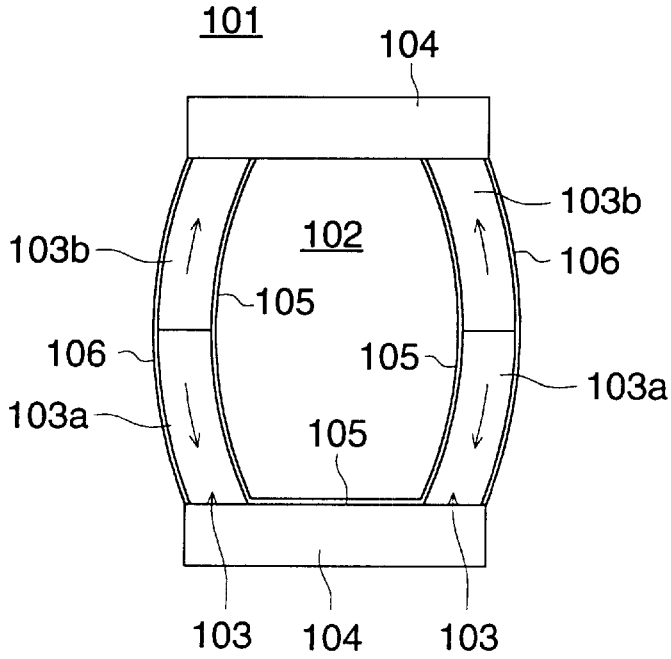
FIGS. 7(*a*) and 7(*b*) are the front view of an ink jet head of the chevron type in further another embodiment.
Figure 7:
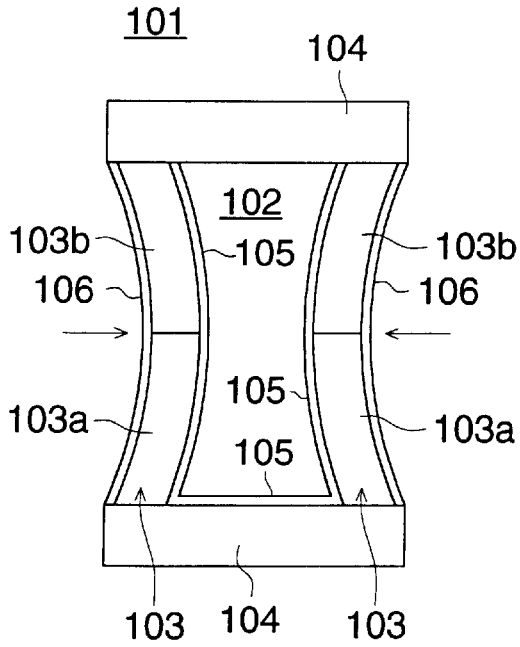

Further, as shown in FIG. 1 to FIG. 6, the ink jet head 101 has the piezoelectric base plates 103 formed in the shape of a plane; however, the plates 103 can also be formed in the shape of a curved surface as shown in FIG. 7. In the case where the piezoelectric base plates 103 are plane-shaped as shown in FIG. 1 to FIG. 6, the head can be made at a low cost. Further, in the case where the plates are curved-surface-shaped as shown in FIG. 7, they are deformed from the state shown in FIG. 7(*a*) to the state shown in FIG. 7(*b*), which means that the amount of deformation of the shape of the space making up the ink chamber 102 is made larger; thus, the ink jet head can carry out a high-speed and high-quality image recording.

Furthermore, as shown in FIG. 8, the ink jet head 101 has the piezoelectric base plates 103 formed in a manner such that the two layers 103*a* and 103*b* have different lengths L1 and L2 (layer thickness or height of wall) in the direction of layer stacking respectively. Owing to the different lengths L1 and L2 in the layer stacking direction of the two layers 103*a* and 103*b*, the shape of the space making up the ink chamber 102 can be deformed in accordance with the position of the nozzle hole 108, and it can jet ink more efficiently from the nozzle hole 108.

Figure 9:
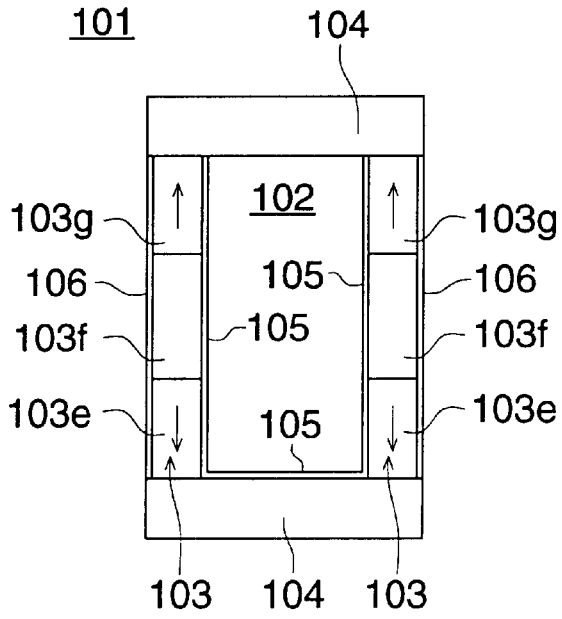
FIGS. 9(*a*) and 9(*b*) are the front view of an ink jet head of the chevron type in another embodiment.
Figure 9:
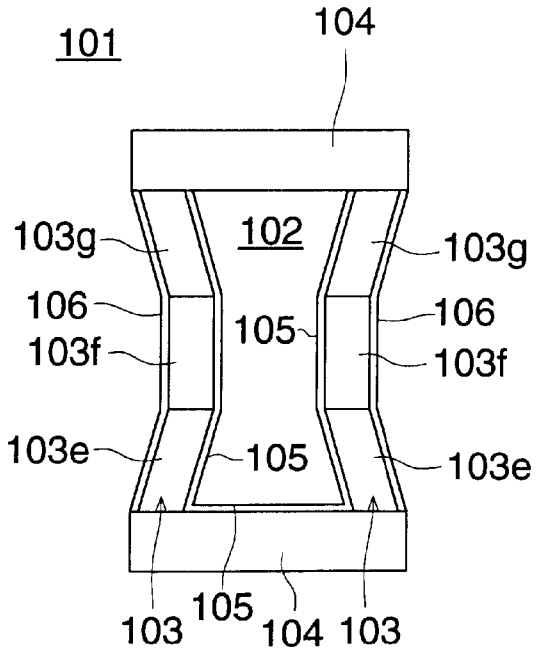
Figure 10:
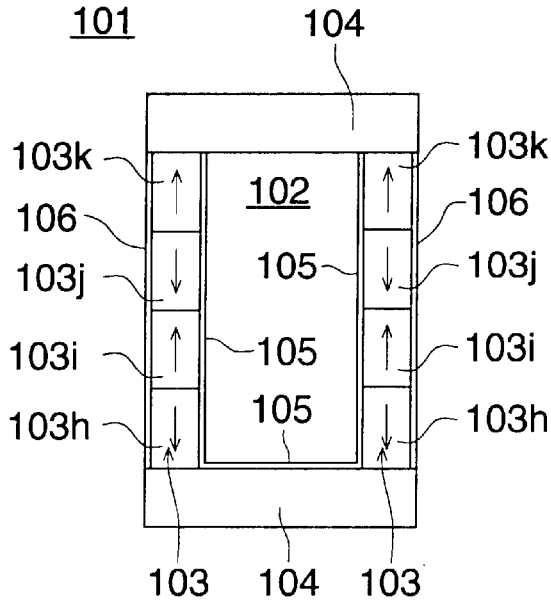
FIGS. 10(*a*) and 10(*b*) are the front view of an ink jet head of the chevron type in another embodiment.
Figure 10:
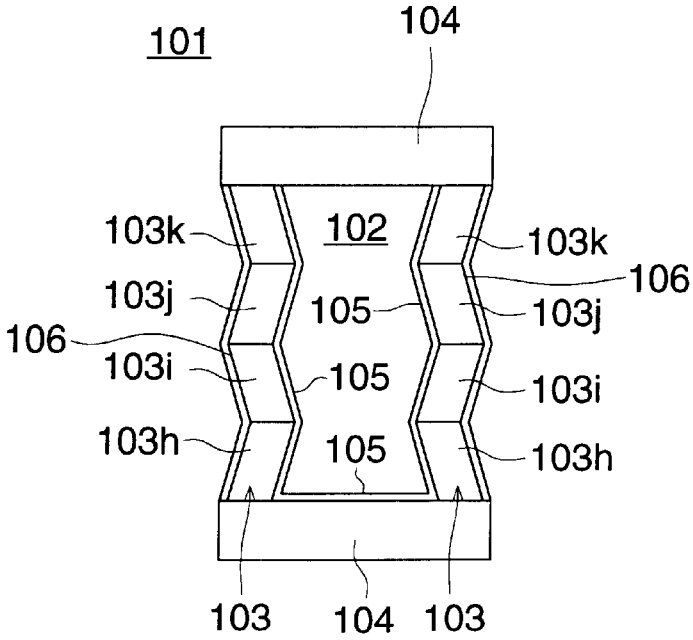
Figure 11:
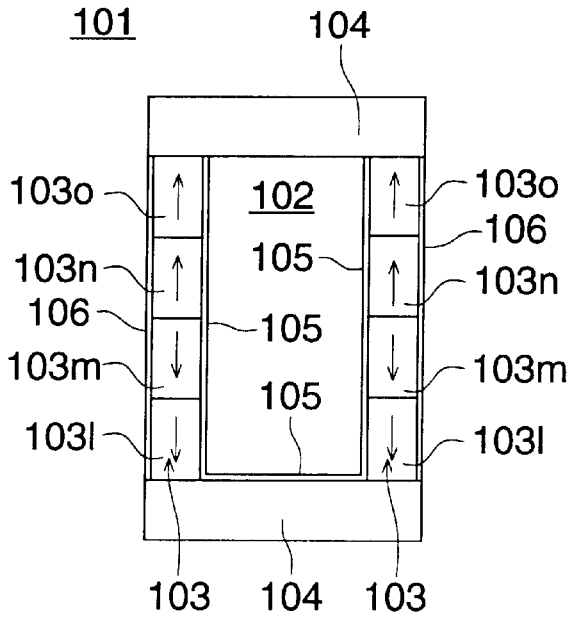
FIGS. 11(*a*) and 11(*b*) are the front view of an ink jet head of the chevron type in another embodiment.
Figure 11:
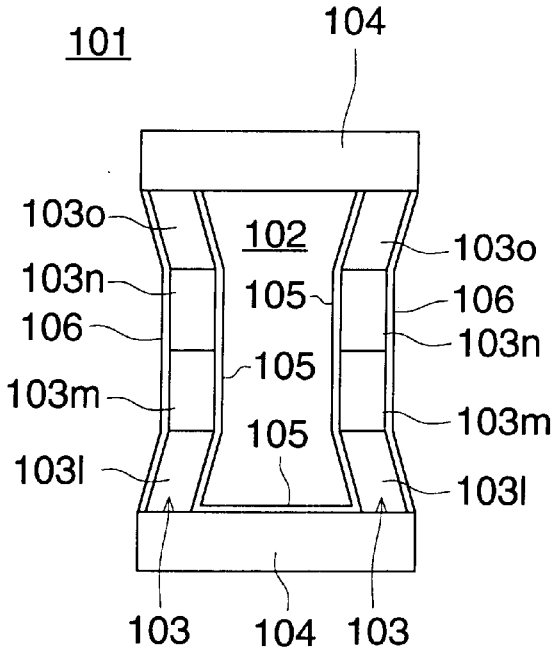

Further, the ink jet head 101 can be made up in a manner shown in FIG. 9 to FIG. 11. In the ink jet head 101 shown in FIG. 9, each of the two piezoelectric base plates 103 has three layers 103*e*, 103*f*, and 103*g*, among which the layers 103*e* and 103*g* are made of a nonmetallic inorganic piezoelectric material and the layer 103*f* is made of a nonmetallic inorganic non-piezoelectric material, and as shown in FIG. 9(*a*), the layers 103*e* and 103*g* have the directions of polarization which are opposite to each other as shown by the arrow marks and the two plates are deformed in such a manner as shown in FIG. 9(*b*). The material of the layer 103*f* is not limited to a nonmetallic inorganic non-piezoelectric material, but a nonmetallic inorganic piezoelectric material or an organic material may be used.

In the ink jet head 101 shown in FIG. 10, each of the two piezoelectric base plates 103 has four layers 103*h*, 103*i*, 103*j*, and 103*k*, each of which is made of a nonmetallic inorganic piezoelectric material and has the direction of polarization which is alternately opposite to its neighbors as shown by the arrow marks in FIG. 10(*a*), and the two plates are deformed in such a manner as shown in FIG. 10(*b*). The material of the layers 103*i* and 103*j* is not limited to a nonmetallic inorganic piezoelectric material, but a nonmetallic inorganic non-piezoelectric material or an organic material may be used.

In the ink jet head 101 shown in FIG. 11, each of the two piezoelectric base plates 103 has four layers 103*l*, 103*m*, 103*n*, and 103*o*, each of which is made of a nonmetallic inorganic piezoelectric material and has the direction of polarization which is opposite to or the same as the others in such a manner as shown by the arrow marks in FIG. 11(*a*), and the two plates are deformed in such a manner as shown in FIG. 11(*b*). The material of the layers 103*m* and 103*n* is not limited to a nonmetallic inorganic piezoelectric material, but a nonmetallic inorganic non-piezoelectric material or an organic material may be used.

As described in the above, in the embodiments shown in FIG. 9 to FIG. 11, the two piezoelectric base plates 103 have three or more layers, and among these three or more layers, the inner layers are made of any one of a nonmetallic inorganic piezoelectric material, a nonmetallic inorganic non-piezoelectric material, and an organic material, and by deforming the shape of the space making up the ink chamber 102 variously, ink can be jetted from the nozzle hole.

Figure 12:
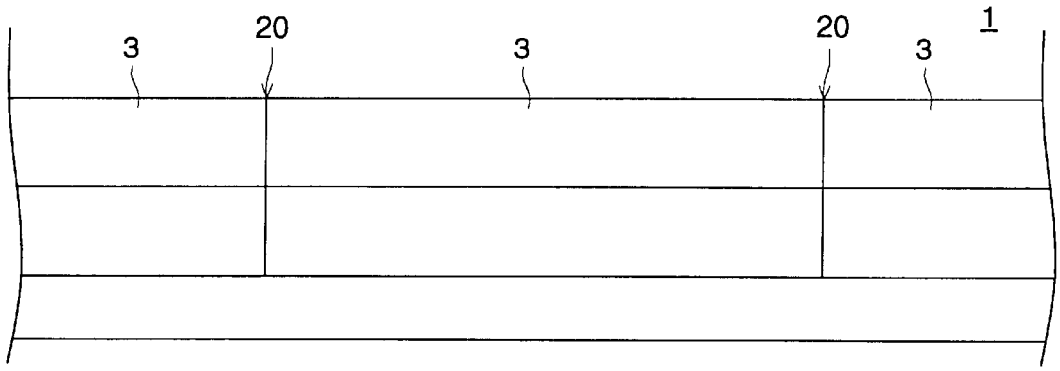
FIGS. 12(*a*) to 12(*c*) are drawings showing an ink jet head of the chevron type.
Figure 12:
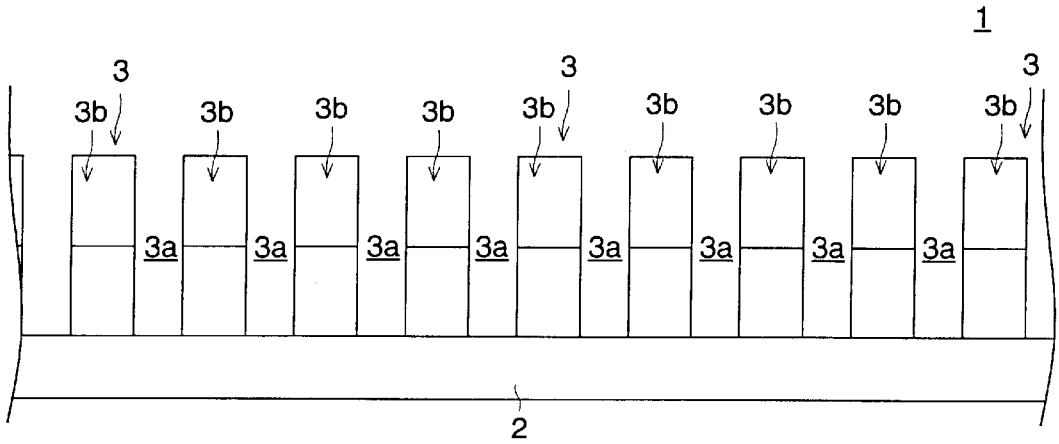
Figure 12:
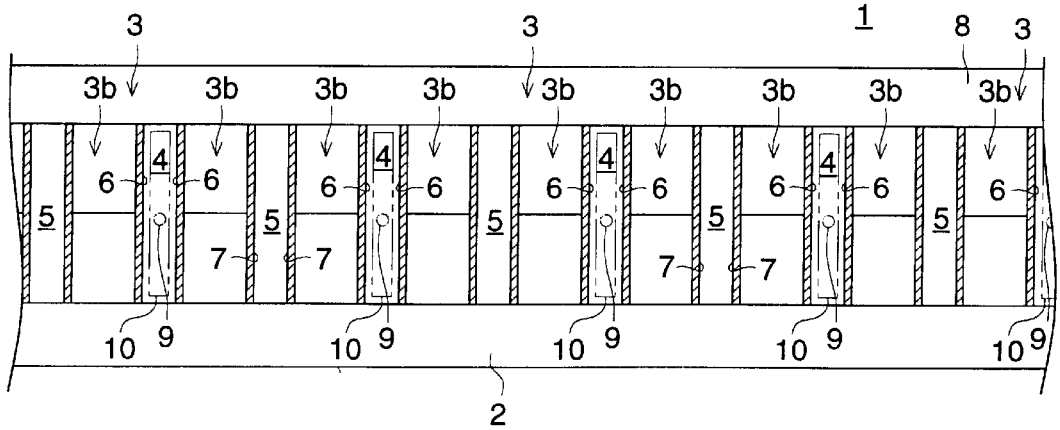

FIG. 12 is a drawing showing an ink jet head of the chevron type; FIG. 12(*a*) shows the state in which a piezoelectric base plate is bonded to a non-piezoelectric base plate, FIG. 12(*b*) shows the state in which a piezoelectric base plate is worked to provide grooves, and FIG. 12(*c*) shows the state in which ink chambers and air chambers are formed.

The ink jet head 1 of this embodiment has two piezoelectric base plates 3 which have the directions of polarization opposite to each other in a layered structure bonded to one another on the long-sized substrate of non-piezoelectric material (FIG. 12(*a*)), and after the bonding, a plurality of grooves 3*a* are formed through at least two layers with a predetermined interval to provide a plurality of ink chambers 4 and air chambers 5 which are partitioned by partition walls 3*b* made up of two layers and positioned alternately (FIG. 12(*b*)).

In this way, when the polarized piezoelectric base plates 3 are arranged side by side, it may be preferable that the grooves 3*a* are formed at the connecting portions 20 at which each edge of these piezoelectric base plates 3 comes to face other edge, in other words, a connecting portion 20 is a joint section between two piezoelectric base plates 3 placed side by side. With this construction, even though there is a minute clearance at the connecting portion 20, the ink chambers 4 and the air chambers 5 can be formed without lowering the positional precision further. In this embodiment, the non-piezoelectric base plates 2, 8 show a single sheet, but a plurality of sheets may be used.

After that, the electrodes 6, and 7 are provided on the whole surface over upper and lower portions of both sides of each of the partition wall 3*b*. After the electrodes 6 and 7 have been formed on the surfaces of the partition walls 3*b*, the non-piezoelectric base plate 8 is bonded to the upper surfaces of the partition walls 3*b* to cover the ink chambers 4 and the air chambers 5; then, on one side of the ink chambers 4, a nozzle plate in which nozzle holes are formed is stuck, and on the other side of the ink chambers 4, the ink supply openings 10 are formed (FIG. 12(*c*)).

Figure 13:
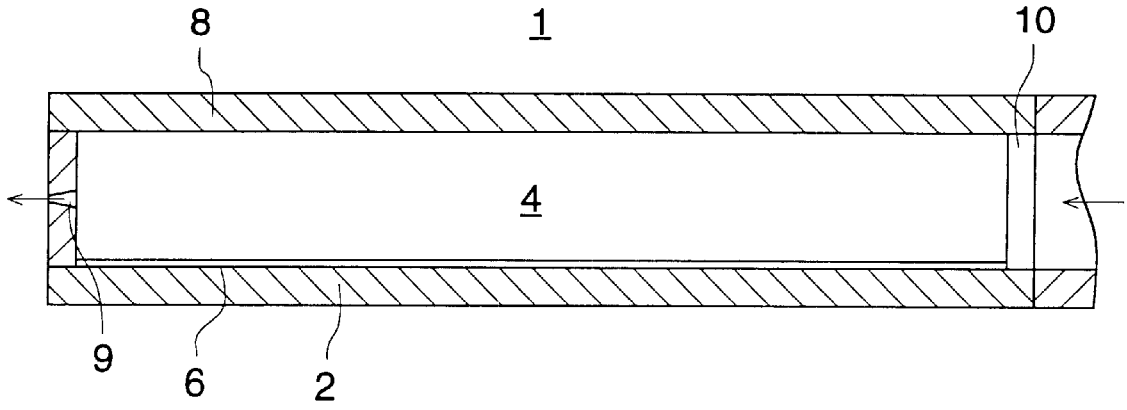
FIG. 13 is a cross-sectional view showing an ink jet head of the chevron type.
Figure 14:
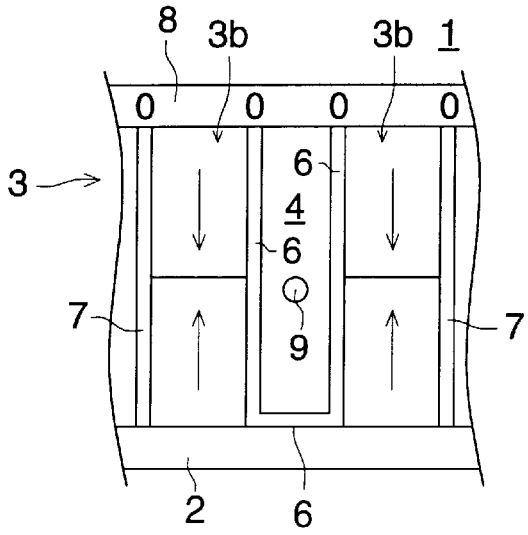
FIGS. 14(*a*) to 14(*c*) are drawings showing the driven state of an ink jet head of the chevron type.
Figure 14:
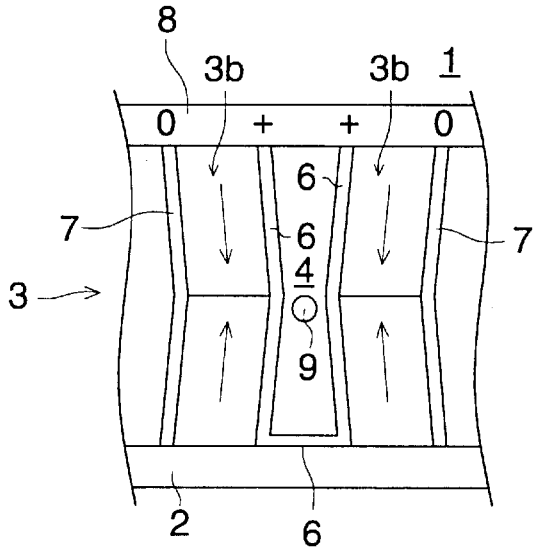
Figure 14:
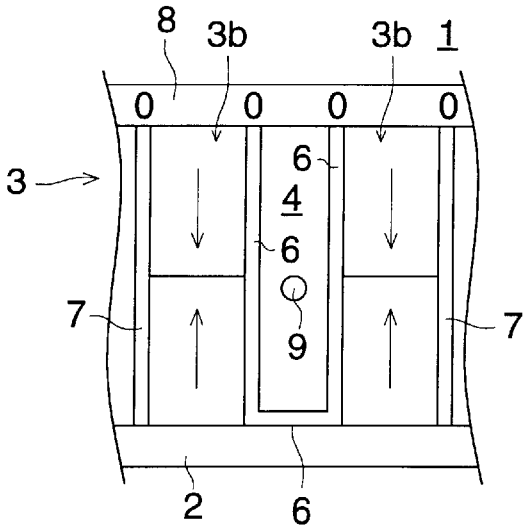

FIG. 13 is a cross-sectional view showing an ink jet head of the chevron type, and FIG. 14 shows an ink jet head of the chevron type in the driven state; FIG. 14(*a*) shows the state before being deformed, and FIG. 14(*b*) shows the ink chamber in the deformed state, and FIG. 12(*c*) shows the state after being released from deformation.

For this ink jet head 1, ink is supplied from the ink supply openings 10 into the ink chambers 4, and the ink supply openings 10 are formed at the opposite positions of the nozzle holes 9. When an electric voltage is applied to the electrodes 6 and 7 of this ink jet head 1, the partition walls 3*b* which partition the ink chambers 4 are deformed to jet ink in the ink chambers 4 out of the nozzle holes 9.

As described in the above, the ink jet head 1 has two layers of piezoelectric material 3 which are formed of a plurality of block shaped pieces connected with one another and have the directions of polarization opposite to each other in a stacked layer structure bonded to one another on the long-sized substrate of non-piezoelectric material, and is provided with the plural ink chambers 4 which are partitioned by the partition walls 3*b* which are made of two stacked layers and formed by forming the plural grooves 3*a* with a predetermined interval; hence, even though the length of one piece of the piezoelectric base plate has a limit for reasons of manufacturing, the ink chambers can be formed without lowering positional precision at the connecting portions 20 of the plural polarized piezoelectric base plate 3, because the plural pieces of the polarized block-shaped piezoelectric base plates 3 are worked to provide the grooves after they are put side by side on the long-sized substrate of non-piezoelectric material 2 to be bonded; thus, it is possible to obtain a high-precision long-sized line head at a low cost, and a high-speed and high-quality image recording can be carried out.

Further, as shown in the manufacturing process of the ink jet head in FIG. 15, the plural piezoelectric base plates 3 having two block-shaped polarized layers is put side by side on the long-sized substrate of non-piezoelectric material 2 shown in FIG. 15(*a*), and even if a minute clearance 21 is present at any one of the connecting portions of these block shaped polarized piezoelectric base plates 3 as shown in the enlarged drawing of the connecting portion in FIG. 15(*b*), the ink chambers can be formed without lowering positional precision by forming the grooves 3*a* at these connecting portions 20 (FIG. 15(*c*)).

Figure 16:
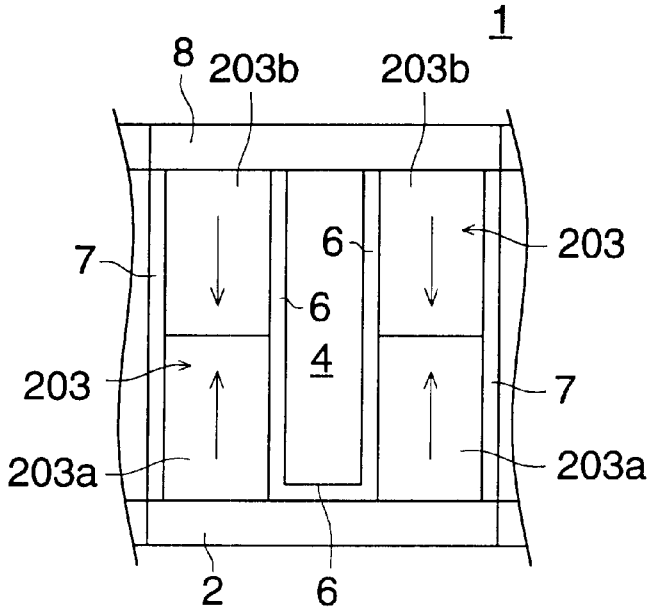
FIGS. 16(*a*) and 16(*b*) are drawing showing the mode of polarization in opposite directions in a plate composed of two layers of piezoelectric material.
Figure 16:
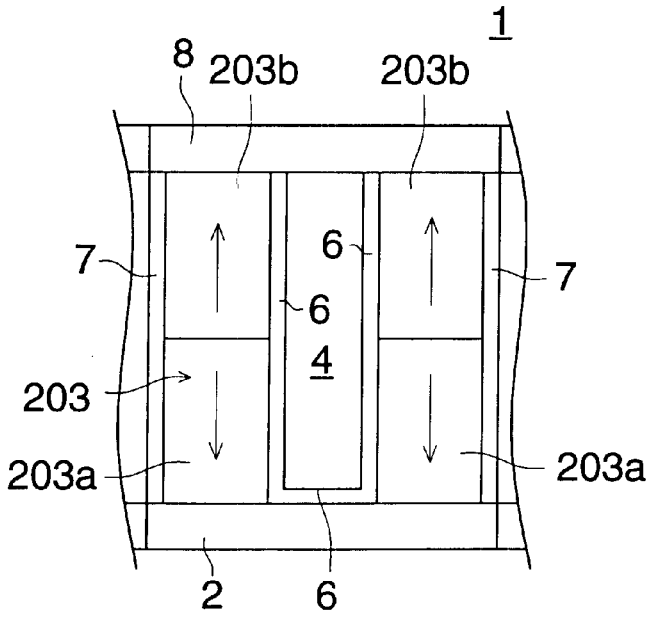
Figure 17:
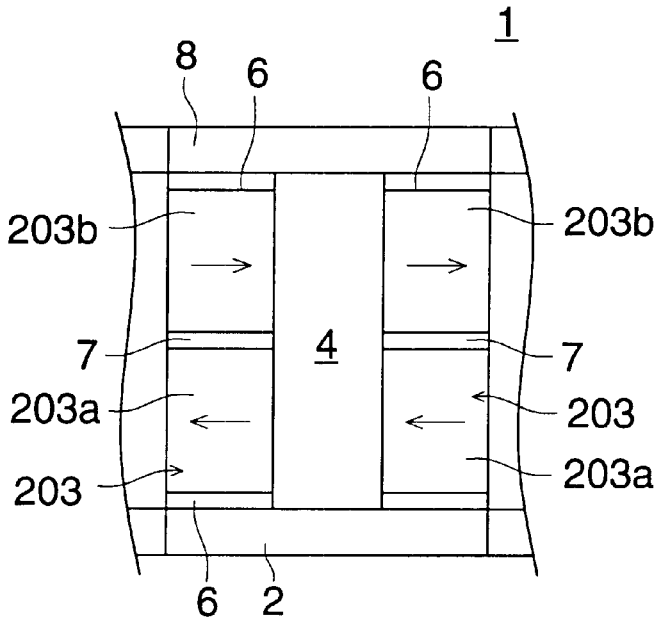
FIGS. 17(*a*) and 17(*b*) are drawings showing the mode of polarization in opposite directions in a plate composed of two layers of piezoelectric material.
Figure 17:
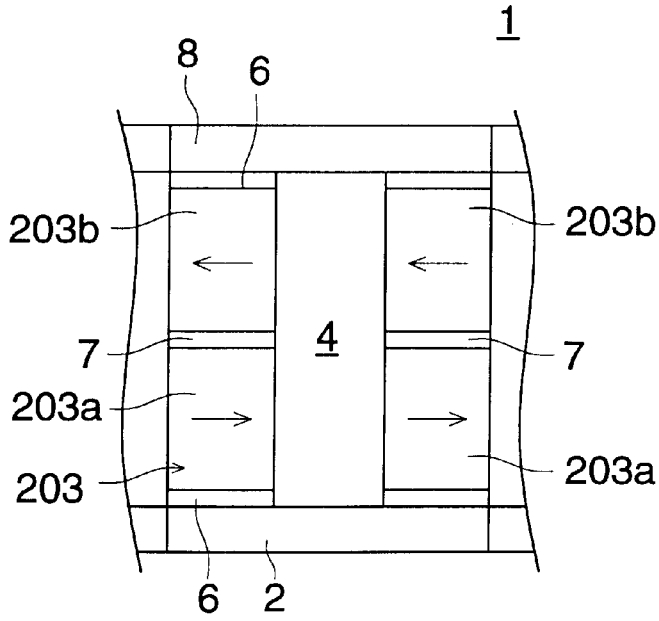

FIG. 16 and FIG. 17 are drawings showing the modes in which the directions of polarization of the two layers made of a piezoelectric material of an ink jet head of the chevron type are opposite to each other. In the embodiment shown in FIG. 16, in one mode shown in FIG. 16(*a*), in respect of the piezoelectric base plates 203 each of which has two layers 203*a* and 203*b* having opposite directions of polarization to each other, the polarization in the layers 203*a* and 203*b* are formed in the directions which are perpendicular to both of the non-piezoelectric base plate 8 and the substrate of non-piezoelectric material 2 and facing each other, and in the other mode shown in FIG. 16(*b*), the polarization in the layers 203*a* and 203*b* are formed in the directions which are perpendicular to both of the non-piezoelectric base plate 8 and the substrate of non-piezoelectric material 2 and going away from each other.

In this ink jet head 1, the ink chamber 4 is formed being surrounded by the piezoelectric base plates 203 having two layers which are given polarization and facing each other and the two non-piezoelectric base plates 2 and 8 facing each other in another way, and the two electrodes 6 and 7 are provided on the both inner and outer sides of the piezoelectric base plate 203 respectively.

In the embodiment shown in FIG. 17, in one mode shown in FIG. 17(*a*), in respect of the piezoelectric base plates 203 each of which has two layers 203*a* and 203*b* having opposite directions of polarization to each other, the polarization in the layers 203*a* and 203*b* are formed in the directions which are parallel to both of the non-piezoelectric base plate 8 and the substrate of non-piezoelectric material 2 and opposite to each other, and in the other mode shown in FIG. 17(*b*), the polarization in the layers 203*a* and 203*b* are formed in the directions which are parallel to both of the non-piezoelectric base plate 8 and the substrate of non-piezoelectric material 2 and reverse to the directions in FIG. 17(*a*). In respect of each of the piezoelectric base plates 203, the electrode 7 is provided between the layers 203*a* and 203*b*; further, the electrode 6 is provided between the layer 203*a* and the substrate of non-piezoelectric material 2, and the electrode 6 is also provided between the layer 203*b* and the non-piezoelectric base plate 8.

In this invention, as the piezoelectric base plate, the material of the base plate is not limited, a base plate made of organic material may be used, however, a base plate made of a nonmetallic piezoelectric material is desirable; as for this plate made of a nonmetallic piezoelectric material, for example, a ceramic plate formed through the processes such as forming and burning, or a plate formed without the necessity of forming and burning may be cited. As the organic material, organic polymer or a hybrid material of organic polymer and inorganic material may be used.

Further, as for the ceramic material, PZT ($PbZrO_3$-$PbTiO_3$) and PZT with a third additive can be cited, and as for the third additive, $Pb(Mg_{1/2}Nb_{2/3})O_3$, $Pb(Mn_{1/2}Sb_{2/3})O_3$, and $Pb(Co_{1/2}Nb_{2/3})O_3$ can be cited. Further, the ceramic plate can also be formed using $BaTiO_3$, ZnO, $LiNbO_3$, $LiTaO_3$, and so forth.

As for the plate formed without the necessity of forming and burning, for example, a plate formed by such as a sol-gel method, or a method of coating a substrate by layer stacking can be cited. According to the sol-gel method, the sol is prepared by adding water, an acid, or an alkali into a uniform solution having a predetermined chemical composition to induce a chemical reaction such as a hydrolysis. Further, by applying the process such as vaporization of the solvent and cooling, it is prepared the sol which has micro-particles of the objective composition or the precursors of the non-metallic inorganic micro-particles dispersed in it, and the plate can be made. In addition to the possibility of adding a minute amount of a different kind of element, a compound having a uniform chemical composition can be obtained by this method; for the starting material, a water-soluble metallic salt such as a sodium silicate or a metallic alkoxide is used. A metallic alkoxide is a compound which is expressed by a general formula $M(OR)_n$, is easily hydrolyzed because the OR radical has a strong basic property, and is varied into a metallic oxide or a hydrate of it through a condensation process as an organic high molecular compound.

Further, there is a method of depositing from the vapor phase as a method of coating a substrate by layer stacking; the methods preparing a ceramic plate from the vapor phase are classified into two kinds of methods which are vapor deposition methods by physical means and methods by a chemical reaction in the vapor phase or on the surface of the plate. Further, the physical vapor deposition methods are further classified into the vacuum deposition method, the sputter method, the ion plating method, etc., and as for the chemical methods, the chemical vapor deposition method (CVD), the plasma CVD method, etc. can be cited. The vacuum deposition method as a physical deposition method (PVD) is a method wherein the objective material is heated in vacuum to evaporate and the vapor is solidified to deposit on the surface of a substrate, and the sputtering method is a method utilizing the sputtering phenomenon in which high-energy particles are let to collide with the objective material (target) and the atoms or molecules on the target surface exchange momentum with the collided molecules to be sprung out from the surface. Further, ion plating method is a method in which the vapor deposition is carried out in an ionized gas environment. Further, in the CVD method, the compound which includes the atoms, molecules, or ions to make up the objective film is vaporized and introduced into the reaction region by a suitable carrier gas, where they are made to react with or to deposit by reaction on a heated substrate to form a film; in the plasma CVD method, the vapor phase state is generated by the energy of a plasma, and a film is deposited by a vapor phase chemical reaction in a comparatively low temperature range of 400 to 500° C.

In this invention, as the non-piezoelectric base plate, the material of the base plate is not limited, a base plate made of organic material may be used, however, a base plate made of a nonmetallic non-piezoelectric material is desirable; as for this plate made of a nonmetallic non-piezoelectric material, for example, a material selected from alumina, aluminum nitride, zirconia, silicon, silicon nitride, silicon carbide, and quartz may used.

As for this non-piezoelectric base plate, there are a ceramic plate which is formed through the processes such as forming and burning, a plate which is formed without the necessity of forming and burning, and so forth. For the ceramic plate formed through-the processes such as burning, for example, $Al_2O_3$, $SiO_2$, mixture of these, and fused mixture of them, and further, $ZrO_2$, BeO, AlN, SiC, etc. can be used. As the organic material, organic polymer or a hybrid material of organic polymer and inorganic material may be used.

In the following, the physical property values of the non-piezoelectric base plate and the piezoelectric base plate will be described.

The density [g/cm$^2$] of the piezoelectric base plate should desirably be 3 to 10, and the density [g/cm$^2$] of the non-piezoelectric base plate should be 0.8 to 10.

The Young's modulus or the coefficient of elasticity [GPa] of the piezoelectric base plate should be 50 to 200, and the Young's modulus [GPa] of the non-piezoelectric base plate should be 100 to 400.

The thermal expansion coefficient [ppm/deg] of the piezoelectric base plate should be 7 to 8, and the thermal expansion coefficient [ppm/deg] of the non-piezoelectric base plate should be 0.6 to 7.

The thermal conductivity [W/cm·deg] of the piezoelectric base plate should be 0.005 to 0.1, and the thermal conductivity [W/cm·deg] of the non-piezoelectric base plate should be 0.03 to 0.3.

The dielectric constant of the piezoelectric base plate should be 1000 to 4000, and the dielectric constant of the non-piezoelectric base plate should be 4 to 100.

The hardness [Hv1.0/GPa] of the piezoelectric base plate should be 2 to 10, and the hardness [Hv1.0/GPa] of the non-piezoelectric base plate should be 2 to 20.

The strength [Kgf/cm$^2$] against bending of the piezoelectric base plate should be 5000 to 2000, and the strength [Kgf/cm$^2$] against bending of the non-piezoelectric base plate [Kgf/cm$^2$] should be 3000 to 9000.

The volume resistivity of the piezoelectric base plate [Ω·cm] should be 0.5 to 10, and the volume resistivity of the non-piezoelectric base plate should be 7 to 10.

Further, the surface roughness Ra of the surfaces to be bonded at the portion between the non-piezoelectric base plate and the piezoelectric base plate should desirably be not larger than 1.0 μm, more desirably be not larger than 0.3 μm, still more desirably be not larger than 0.1 μm. The surface roughness Ra is obtained in such a manner that the non-piezoelectric base plate and the piezoelectric base plate are peeled off, a surface roughness is measured for each peeled surface of the non-piezoelectric base plate and the piezoelectric base plate and the surface roughness Ra is obtained as an average value of the measured values. If the surface roughness of the surfaces to be bonded exceeds 1.0 μm, a large amount of the soft high molecular adhesive (for example, an epoxy resin) enters between the surfaces to be bonded, which makes the driving force of the plate of nonmetallic inorganic piezoelectric material decrease, and brings about the lowering of sensitivity and the rise in electric voltage; this is not desirable.

The relationship between the surface roughness Ra of the surfaces to be bonded of the non-piezoelectric base plate and the piezoelectric base plate and the driving voltage value is shown in Table 1.

TABLE 1

| Ra of piezoelectric ceramic plate | Ra of non-piezoelectric ceramic plate [μm]. | | | | |
|---|---|---|---|---|---|
| [μm] | 2.0 | 1.0 | 0.5 | 0.3 | 0.1 |
| 2.0 | 27 V C | 25 V C | | 23 V C | C |
| 1.0 | 25 V C | 20 V A | | | |
| 0.5 | | | 19 V A | | |
| 0.3 | 23 V C | | | 18 V AA | |
| 0.1 | C | | | | 17 V AA |

In Table 1, AA indicates the case where no soft high molecular adhesive (for example, an epoxy resin) enters into the concave portions on the bonded surfaces, the driving voltage is low, and electric power saving is accomplished, A indicates the case where a small amount of the adhesive enters, and C indicates where a large amount of the adhesive enters.

Further, the surfaces to be bonded of the non-piezoelectric base plate and the piezoelectric base plate are subjected to plasma processing or UV processing. The plasma processing is a processing in which a non-piezoelectric base plate or a piezoelectric base plate is placed in a vacuum chamber, and any one or a mixed gas of the two or more of Ar, $N_2$, and $O_2$ is introduced, and brought into the state of plasma by an electromagnetic field applied by an outside power source, and a fluorinated hydrocarbon gas such as a $CF_4$ gas may be suitably used in order to enhance the etching performance of the surface. Further, UV processing is doing a process in which the ultraviolet ray from a UV emitting lamp is applied directly onto the non-piezoelectric base plate or the piezoelectric base plate, and it may suitably be done in the atmosphere of $O_2$ in order to produce the cleaning effect by ozone.

By applying plasma processing and UV processing to the surface to be bonded in this way, contamination by organic substances can be cleaned and removed, and poor bonding such as residual micro-bubbles can be eliminated owing to the improved wetting ability over the whole surface for the adhesive; therefore, poor driving of the piezoelectric base plate can be eliminated and stable ink jet heads can be manufactured.

Incidentally, in the ink jet head of the shearing mode of this kind, an ink chamber and an air chamber are formed alternatively on a polarized piezoelectric element by forming grooves, and electrodes are provided on the sides of both walls on each of the ink chamber and the air chamber, the electrode surface is insulated, and voltage is impressed on each electrode so that walls of the ink chamber are subjected to shear deformation to jet ink from an orifice. Since this pressurizing chamber and ink chamber are made solidly by piezoelectric ceramics, the structure of the head is extremely simple. In addition, since the ink chamber is made of ceramics, it is not damaged by ink, the strength of the ink chamber is high, and the structure is simple and strong, resulting in an ink jet head suitable for high density.

Figure 27:
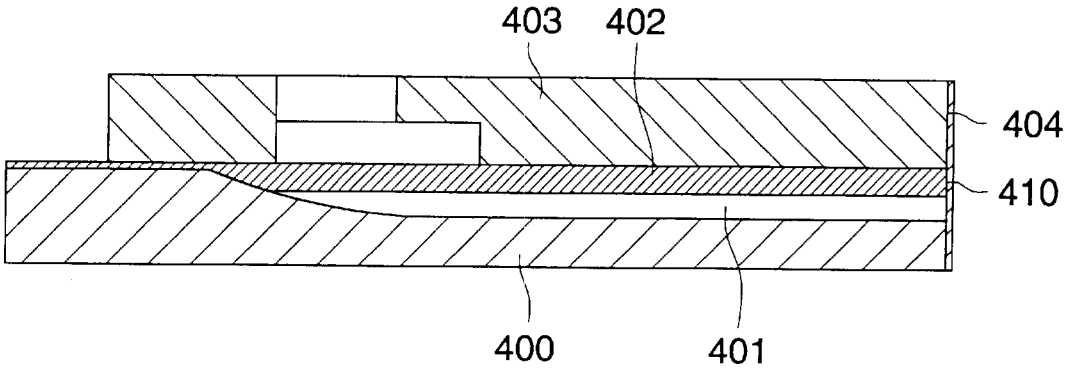
FIG. 27 is a longitudinal sectional view of a conventional ink jet head.

The shearing mode ink jet head to jet ink by shear-deforming walls in the ink chamber formed by a piezoelectric element is of the structure wherein ink groove 401 is provided directly on thin plate 400 of the polarized piezoelectric element as shown in FIG. 27, but the structure of the ink groove 401 is not simple, and there are formed plural ink grooves 401 each being of a rear end shallow groove type wherein a depth of the groove is gradually reduced to be zero at the rear end. In some ink jet heads, electrodes 402 are provided on both left and right walls of each of these ink grooves 401, then, after insulating each electrode 402, top plate 403 is attached to cover the top of the groove, and nozzle plate 404 having orifice 410 on the tip of the groove is attached to form the ink jet head.

As the ink jet head of this kind, there are given ink jet heads disclosed in, for example, TOKKOHEI Nos. 6-6375 and 6-61936, and in each of these ink jet heads, an ink chamber and an air chamber are provided alternatively, electrodes are provided on walls and insulated, and voltage is impressed on the electrode of the ink chamber, while, the electrode of the air chamber is grounded.

However, in the case of the conventional shearing mode ink jet head wherein the tip of the ink chamber is covered by a nozzle plate, and the rear end of the groove is made shallow to block the ink flow path, ink needs to be supplied through the opening on the top plate, and an ink inlet is perpendicular to the head, and air bubbles tend to stay at the ink inlet, which has been a drawback.

As an ink jet head wherein plural ink chambers and air chambers are formed alternately on polarized piezoelectric elements by dividing with walls, there is given a shearing mode ink jet head disclosed in TOKKAIHEI No. 7-132589, and in some of the shearing mode ink jet heads, the electrode of the ink chamber is grounded, and voltage is impressed on the electrode of the air chamber to drive. This ink jet head has a merit that the electrode of the ink chamber does not need to be insulated.

However, it is necessary to provide electrodes in two types because the structure of an electrode of the ink chamber is different from that of the air chamber, and it is necessary to connect the electrode of the air chamber with that of the adjoining air chamber. It is necessary to prepare electrodes differently for the ink chamber and the air chamber, and to provide a communicating line which connects the air chamber to another air chamber so that the communicating line may bypass the ink chamber. It is therefore necessary to provide slits perpendicular to the groove on the tip and rear end of the groove and to provide electrodes in the slits. Since it is necessary to provide an ink flow path, a slit and a bypass wiring around a minute orifice, the structure is complicated and it is difficult to attain high density.

Therefore, the following structures are preferable to provide a simply-structured ink jet head which is free from a lump of air bubbles and is capable of jetting ink stably at high speed and a manufacturing method of the ink jet head, and to provide an ink jet head wherein formation of electrodes and connection of signals are simple, and high density is favorably attained, and a manufacturing method of the ink jet head.

(B-1) An ink jet head in which plural ink chambers and air chambers are formed alternately on a head main body of polarized piezoelectric element by dividing with walls, and voltage is impressed on an electrode on the head main body to make the walls forming the ink chamber to be subjected to shear deformation so that ink may be jetted from an orifice, wherein the head main body has an orifice to jet ink on the outlet side of the ink chamber and has an ink guiding inlet at the position opposing the orifice on the inlet side of the ink chamber, an ink flow path through which ink is supplied from the ink guiding inlet to the orifice is formed, and electrodes provided on both walls forming the ink chamber are connected to signal lines by connecting with connection electrodes, while, electrodes provided on both walls forming the air chamber are grounded by connecting with connection electrodes.

In the invention described in (B-1), the shearing mode ink jet head has a merit that the structure is simple and suitable for high density, and the ink chamber is hardly damaged by ink, but it has a drawback that mutual interference is great between adjoining ink chambers and high frequency jetting is impossible accordingly because ink is jetted by shear deformation of the walls. However, when an ink chamber and an air chamber are provided alternately, the mutual interference can be prevented and stable jetting at high frequency is possible because air having low density absorbs vibration of ink effectively.

Owing to the air chamber provided in the ink jet head, interference between adjoining ink chambers is eliminated, thereby, a shallow groove which has so far been provided at the rear end of an ink flow path for attenuating the residual pressure wave is not necessarily needed, and it is possible to form a straight ink flow path from the ink guiding inlet to the orifice, thus, air bubbles are easily ejected out of the ink chamber, and no air bubble stays in the ink chamber.

Further, the straight ink flow path for supplying ink from the ink guiding inlet to the orifice is formed in the ink chamber, and even if air bubbles which absorb pressure impressed on ink for its jetting to make the jetting to be impossible enter the ink flow path, the bubbles are easily ejected out of the ink flow path, resulting in no fear that air bubbles stay in the ink flow path, thus, the simple structure eliminates stay of air bubbles and makes it possible to jet ink stably at high speed.

In addition, the electrodes provided on both walls forming the ink chamber are connected with signal lines by connecting with connection electrodes, and electrodes provided on both walls forming the air chamber are grounded by connecting with connection electrodes, which makes electrode formation and signal connection to be simple, and is advantageous for high density.

Furthermore, owing to the ink chamber in which a straight ink flow path is formed, it is possible to stick a resin nozzle plate to the end portion of the ink chamber, and to make a hole by irradiating an excimer laser beam from the ink chamber side after the sticking is hardened. Therefore, a merit for production is greater and positional accuracy of the orifice is more improved, compared with an occasion where the orifice is made by an excimer laser beam and then is positioned accurately to be stuck to the ink chamber.

(B-2) The ink jet head described in (B-1) represented by a head unit in which plural ink chambers and air chambers are formed alternately on a head main body of polarized piezoelectric element by dividing with walls, and voltage is impressed on an electrode on the head main body to make the walls forming the ink chamber to be subjected to shear deformation so that ink may be jetted from an orifice, wherein a plurality of the head units are connected to be structured.

In the invention according to (B-2) above, a plurality of the head units are connected to be structured, and thereby, it is possible to obtain, at low cost, a long line head which is highly accurate, in addition to (B-1), and it is possible to record images of high image quality at high speed.

(B-3) The ink jet head described in (B-1) or (B-2), wherein the groove forming the ink chamber has its portion having a fixed depth and a portion whose depth is gradually reduced toward the orifice side.

In the invention described in (B-3), since the groove which forms the ink chamber has its portion having a fixed depth and a portion whose depth is gradually reduced toward the orifice side, no air bubbles stay at the portion on the part of the orifice, and stable and high speed jetting of ink is possible accordingly.

(B-4) The ink jet head described in (B-1) or (B-2), wherein the ink guiding inlet is a small hole whose sectional area is smaller than that of the straight ink flow path.

In the invention described in (B-4), the ink guiding inlet is a small hole whose sectional area is smaller than that of the straight ink flow path and thereby, it is lightened that pressure impressed on ink escapes from the ink guiding inlet, which makes it possible to prevent that an amount of jetted ink and jetting speed are lowered.

(B-5) The ink jet head described in (B-1) or (B-2), wherein the ink guiding inlet is a hole whose sectional area is mostly the same as that of the straight ink flow path.

In the invention described in (B-5), the ink guiding inlet is a hole whose sectional area is mostly the same as that of the straight ink flow path, and thereby, manufacturing is easy, and no crooked portion exists, eliminating stay of air bubbles, and stable and high speed jetting of ink is possible.

(B-6) A manufacturing method of an ink jet head wherein plural grooves are formed on a head main body of a polarized piezoelectric element, electrodes are provided on the inside of both walls of the groove, a cover base board is attached on the head main body to close the top of the groove, the outlet side of the groove is closed by a nozzle plate after the electrode is insulated, the inlet side thereof is closed with a supply plate, a plurality of ink chambers and air chambers are formed alternately, an orifice is formed on the nozzle plate at the position where the ink chamber is formed, an ink guiding inlet is formed on the supply plate at the position where the ink chamber is formed, a straight ink flow path for supplying ink from the ink guiding inlet to the orifice is formed, the electrodes provided on both walls forming the ink chamber are connected to signal lines by connecting with connection electrodes, and the electrodes provided on both walls forming the air chamber are grounded by connecting with connection electrodes.

In the invention described in (B-6), an electrode having the same shape can be used both in the ink chamber and the air chamber because the electrode is insulated, and the head structure, an electrode forming method and a signal connection method are extremely simple because the electrode does not need to be connected between both air chambers, bypassing the ink chamber, and it is easy to attain high density of the head and to make a long head. In particular, it is easy to make a line head having hundreds of ink chambers.

(B-7) A manufacturing method of an ink jet head wherein plural grooves are formed on a head main body of a polarized piezoelectric element, electrodes are provided on the inside of both walls of the groove, a cover base board is attached on the head main body to close the top of the groove, a resin nozzle plate on which no orifice is formed is cemented on the outlet side of the groove after the electrode is insulated, then, an excimer laser beam is irradiated through the ink chamber to make an orifice, an inlet side is covered with a supply plate, plural ink chambers and air chambers are formed alternately, an ink guiding inlet is formed on the supply plate at the position where the ink chamber is formed, a straight ink flow path for supplying ink from the ink guiding inlet to the orifice is formed, electrodes provided on both walls forming the ink chamber are connected to signal lines by connecting with connection electrodes, and electrodes provided on both walls forming the air chamber are grounded by connecting connection electrodes.

In the invention described in (B-7), since the ink flow path is straight, it is possible to irradiate the excimer laser beam from the ink chamber side after cementing a nozzle plate where no orifice is made on the end portion of the ink chamber to make an orifice, which makes a complicated and precise positioning apparatus for an orifice to be unnecessary, and improves sharply the productivity and reliability of heads.

Since the electrode is insulated, an electrode having the same shape can be used both in the ink chamber and the air chamber, and the electrode does not need to be connected between both air chambers, bypassing the ink chamber. Therefore, the head structure, an electrode forming method and a signal connection method are extremely simple, and it is easy to attain high density of the head and to make a long head. In particular, it is easy to make a line head having hundreds of ink chambers.

(B-8) The manufacturing method of an ink jet head described in (B-6) or (B-7) represented by a head unit in which plural ink chambers and air chambers are formed alternately on a head main body of polarized piezoelectric element by dividing with walls, and voltage is impressed on an electrode on the head main body to make the walls forming the ink chamber to be subjected to shear deformation so that ink may be jetted from an orifice, wherein a plurality of the head units are connected.

In the invention described in (B-8), since plural head units are connected to be structured, it is possible to obtain, at low cost, a long line head which is highly accurate, in addition to (B-6) or (B-7), and it is possible to record images of high image quality at high speed.

(B-9) The manufacturing method of an ink jet head described in (B-7), wherein the resin nozzle plate is made of polyimide, polyetherimide, polysulfone, polyethersulfone, polyethylene terephthalate, or polycarbonate on which a hole can be made by an excimer laser beam.

In the invention described in (B-9), the nozzle plate is made of resin such as polyimide, polyetherimide, polysulfone, polyethersulfone, polyethylene terephthalate, or polycarbonate, and it is possible to make an orifice at an accurate position on the nozzle plate with an excimer laser beam.

(B-10) The manufacturing method of an ink jet head described in either one of (B-6)–(B-9), wherein the groove on the head base board is formed through grinding by a diamond grinder.

In the invention described in (B-10), the grooves on the head base board are made through grinding by a diamond grinder, and they are formed to be in the same shape and to be in parallel with each other, accordingly.

(B-11) A manufacturing method of the ink jet head described in either one of (B-6)–(B-10) wherein the groove which forms the ink chamber has a portion having the fixed depth and a portion where the depth is gradually reduced toward the orifice side.

In the invention described in (B-11), no air bubbles stay on the orifice side and stable and high speed jetting of ink is possible, because the groove which forms the ink chamber has a portion having the fixed depth and a portion where the depth is gradually reduced toward the orifice side. The depth of the groove can be controlled by raising the position of a dicing saw, and it can be formed easily.

(B-12) A manufacturing method of the ink jet head described in either one of (B-6)–(B-11), wherein a protection film is provided on the top portion of each groove on the head base board, then, metal which forms an electrode is evaporated from an evaporation source located on a plane which forms a fixed angle with an extended plane of the groove wall so that the metal may be deposited up to the fixed depth of the groove wall, and then, the protection film is removed after the evaporation of the metal to form an electrode.

In the invention described in (B-12), it is possible to form an electrode simply on the groove wall, by evaporating metal which forms an electrode from an evaporation source located on a plane which forms a fixed angle with an extended plane of the groove wall to deposit the metal up to the fixed depth of the groove wall, and by removing the protection film after the evaporation of the metal.

(B-13) A manufacturing method of the ink jet head described in either one of (B-6)–(B-12), wherein a photosensitive resin layer is provided on the end portion at the ink supply side on the head main body, and on the cover base board, then, at least a part of the opening at the ink supply side on each groove and a portion where a surface electrode is provided are masked through patterning, and then, metal which forms an electrode is evaporated from an evaporation source located on a plane which forms an acute angle with an extended plane of the groove bottom wall toward the cover base board so that a connection electrode which communicates with the electrode provided on each of both walls inside each groove may be formed.

In the invention described in (B-13), it is possible to form simply a connection electrode which communicates with the electrode provided on each of both walls inside each groove, by masking at least a part of the opening at the ink supply side on each groove and a portion where a surface electrode is provided through patterning and by evaporating metal which forms an electrode from an evaporation source located on a plane which forms an acute angle with an extended plane of the groove bottom wall toward the cover base board.

(B-14) A manufacturing method of the ink jet head described in either one of (B-6)–(B-13), wherein a polyparaxylylene resin film is coated on the plane including the electrodes provided on both walls inside each groove and the connection electrodes communicating with the aforesaid electrodes, to insulate the electrodes and the connection electrodes.

In the invention described in (B-14), it is possible to form a uniform film even on the complicated head base body and to insulate securely the electrodes and the connection electrodes, because the polyparaxylylene resin film is formed by a vapor phase polymerization method.

Embodiments of an ink jet head and a manufacturing method of the ink jet head of the invention will be explained as follows, to which the embodiment of the invention is not limited.

Figure 18:
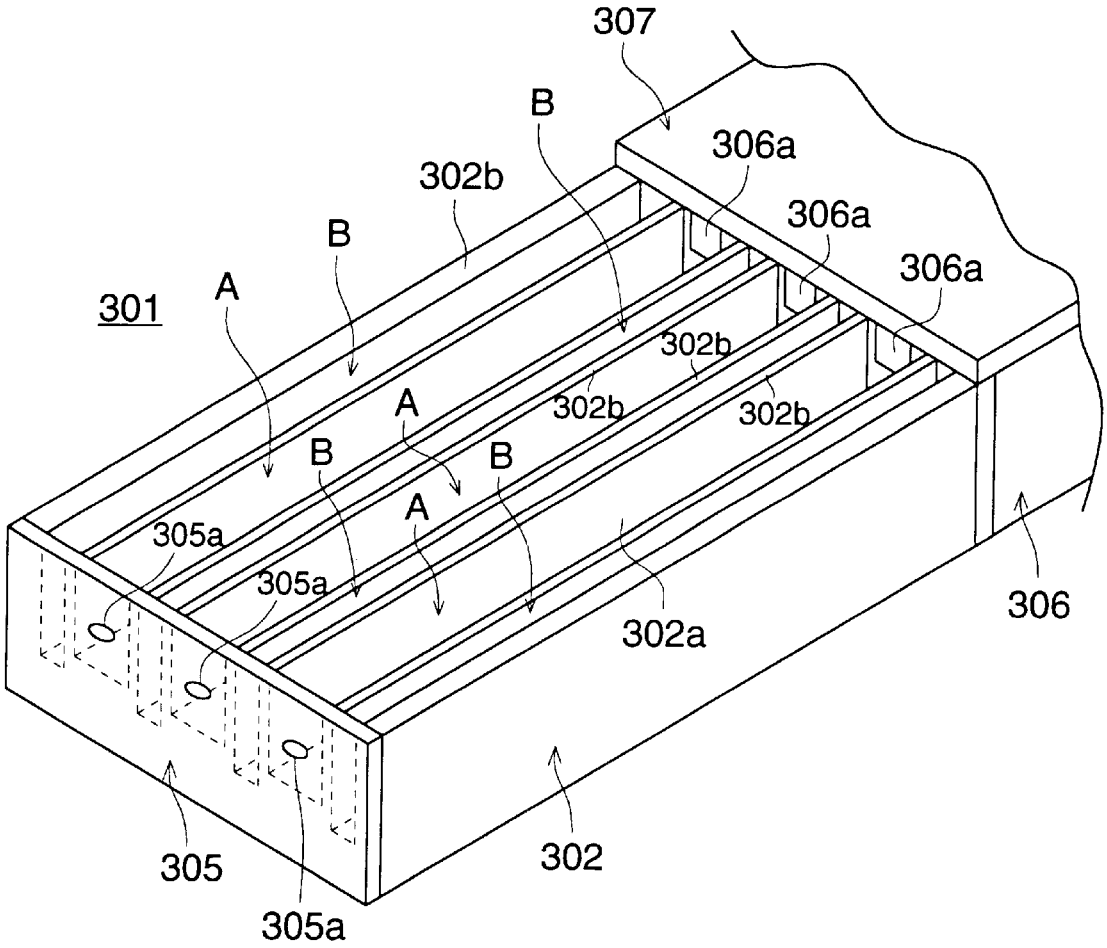
FIG. 18 is a perspective view of an ink jet head.
Figure 20:
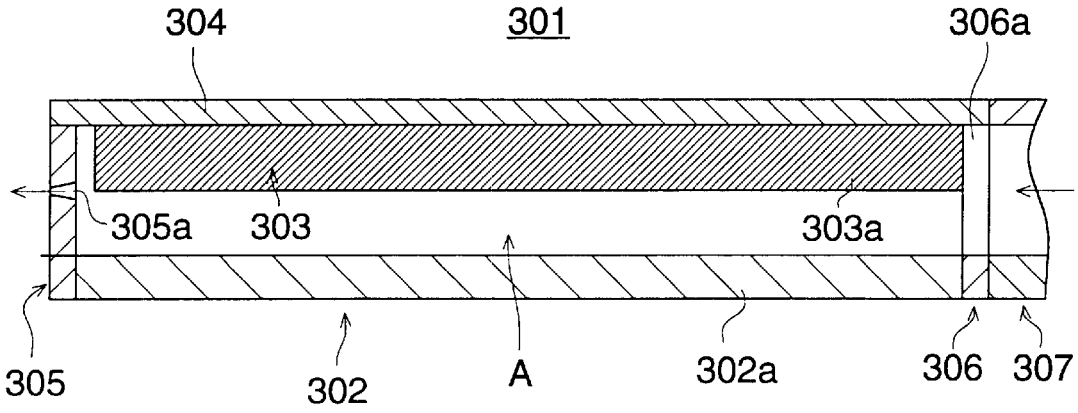
FIG. 20 is a longitudinal sectional views of an ink jet head.

FIG. 18 is a perspective view of an ink jet head, FIG. 19 is a lateral sectional view of an ink head, and FIG. 20 is a longitudinal sectional view of an ink jet head.

In shearing mode type ink jet head 301, plural grooves 302*a* are formed on head base board 302 representing a polarized piezoelectric element, electrodes 303 are provided on the inner sides of both walls 302*b* of the groove 302*a*, cover base board 304 is attached on the head base board 302 to close the top of the groove 302*a* after the electrode 303 is insulated, further, the outlet side of the groove 302*a* is covered by nozzle plate 305 and the inlet side is covered by supply plate 306, thus, plural ink chambers A and air chambers B are formed alternately, and ink supply section 307 is connected to the supply plate 306.

At the portion corresponding to ink chamber A on the nozzle plate 305, there is formed orifice 305*a*. Since the orifice 305*a* is formed so that it may be reduced gradually in terms of diameter toward the jetting direction, flowing resistance of ink is lowered, and even when air bubbles enter from the outside, the bubbles move to the portion where a hole diameter is smaller under the Laplace's Law, and are ejected automatically. On the supply plate 306, there is formed ink guiding inlet 306*a* at the position corresponding to ink chamber A.

When the size of the ink guiding inlet 306*a* is made to be the same as that of a section of the ink chamber as shown in FIG. 19(*a*), it is preferable because no air bubbles stay there. However, when the ink guiding inlet 306*a* is not tapered downs pressure applied on ink escapes from the ink guiding inlet 306*a*, and an amount of jetted ink and the jetting speed are lowered. Therefore, it is preferable to taper down slightly as shown in FIG. 19(*b*). Or, it is also possible to make the ink exclusion volume to be greater to compensate by lengthening ink chamber A and a driving portion, without tapering down the ink guiding inlet 306*a*.

As stated above, head main body 310 is composed of polarized head base board 302, cover base board 304, nozzle plate 305 and supply plate 306, and plural ink chambers A and air chambers B are formed with walls alternatively on the head main body 310. The head main body 310 has orifice 305*a* on the outlet side of ink chamber A, and has ink guiding inlet 306*a* at the position opposing the orifice 305*a* on the inlet side of ink chamber A, and there is formed a straight ink flow path through which ink is supplied from the ink guiding inlet 306*a* to the orifice 305*a*.

Voltage is impressed on electrode 303 on head main body 310 representing a polarized piezoelectric element to jet ink from orifice 305*a* by making wall 302*b* forming ink chamber A to be subjected to shear deformation, as stated above, and there is formed, on ink chamber A, a straight ink flow path through which ink is supplied from the ink guiding inlet 306*a* to the orifice 305*a*, thus, air bubbles do not stay in the simple structure, and stable and high speed jetting of ink is possible.

Figure 21:
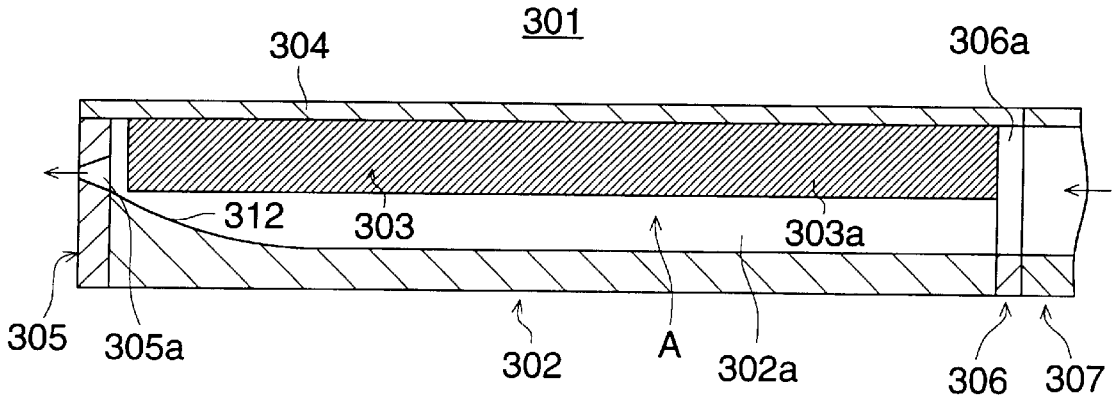
FIGS. 21(*a*) and 21(*b*) are diagrams showing the structure of an ink chamber of an ink jet head.
Figure 21:
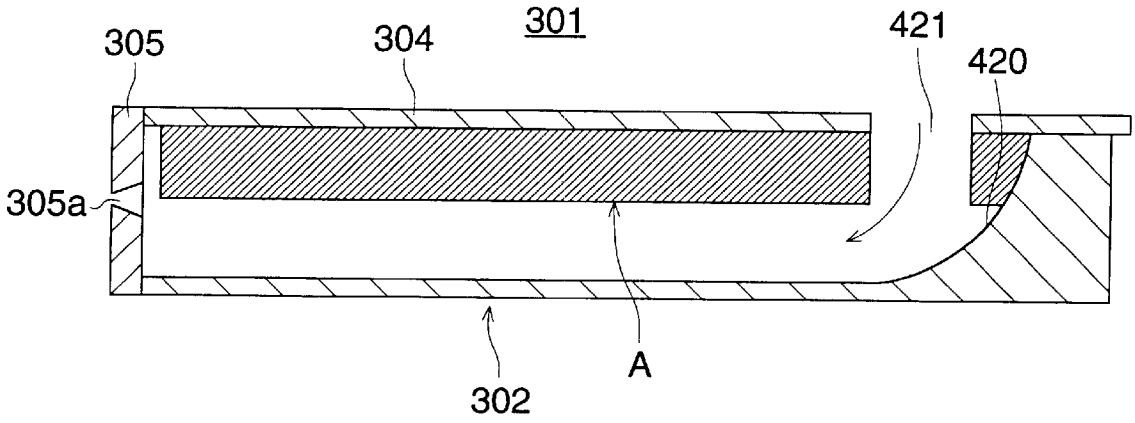

Ink chamber A on ink jet head 301 can be structured as shown in FIG. 21, and FIG. 21(*a*) shows an embodiment of the invention, while, FIG. 21(*b*) shows a conventional example. In FIG. 21(*a*) of the present embodiment, a straight ink flow path is made to be shallower at the position on the orifice side, and thereby the step on the cementing portion between the end portion of the ink flow path and nozzle plate 305 is made to be smaller, and the depth of the groove can be controlled by changing the position of a dicing saw.

Since the step on the cementing portion between the end portion of the ink flow path and nozzle plate 305 is made to be smaller by making the groove to be shallower on the orifice side, no air bubbles stay on the orifice side, and stable and high speed jetting of ink is possible.

In making a part of the groove on head base board 302, grooves 302*a* on head base board 302 are made through grinding by a diamond grinder to be in the same shape and to be in parallel with each other. The groove 302*a* which forms ink chamber A has a portion having a fixed depth and a portion where the depth is gradually reduced at least towards the orifice side, and thus, no air bubbles stay at the orifice side or the ink guiding inlet side, and stable and high speed jetting of ink is possible.

After the resin nozzle plate on which no orifice is formed is cemented, an excimer laser beam is irradiated through ink chamber A to make orifice 305*a* with a laser beam. When making a hole by irradiating an excimer laser beam through ink chamber A having a straight ink flow path, after cementing, heating and hardening resin nozzle plate 305 having thereon no orifice, it is possible to make orifice 305*a* at the accurate position. Further, adhesive agents do not flow in. Further, when a hole is made by an excimer laser beam, a diameter of the hole on the side for the laser beam to enter is greater than that on the side for the laser beam to emerge. Therefore, when making a hole by irradiating from the ink chamber side, an orifice wherein jetting resistance is low and air bubbles hardly enter can be made. Resin nozzle plate 305 is made of resin such as polyimide, polyetherimide, polysulfone, polyethersulfone, polyethylene terephthalate, or polycarbonate, which can be subjected to hole making by an excimer laser beam, and orifice 305*a* can be made at the precise position by the excimer laser beam. In contrast to this, U.S. Pat. No. 5,189,437 discloses a method wherein a resin plate is cemented on the end portion of an ink flow path, and then, an excimer laser beam is irradiated from the outside (opposite side of an ink chamber) while a head is being vibrated, to make an orifice on which a nozzle diameter on the jetting side is smaller. In this method, operation is difficult and energy efficiency is poor.

As stated above, the embodiment of the invention is a head capable of conducting high frequency jetting wherein ink chamber A which jets ink and air chamber B which jets no ink and contains air are provided alternately so that propagation of pressure may be prevented between ink chambers A. In the case of the conventional example, a shearing mode ink jet head is of the structure wherein there is provided, at the rear end portion of ink chamber A, shallow groove 420 where a residual acoustic wave caused by jetting is reflected and is interfered with an incidence wave to be attenuated so that pressure may not be propagated to adjoining ink chamber A, as shown in FIG. 21(*b*).

In the present embodiment, it is possible to prevent surely pressure propagation to adjoining ink chamber A by providing air chamber B between ink chamber A and next ink chamber A. Therefore, it is not always necessary to provide shallow groove 303*a* at the rear end portion of an ink flow path as shown in FIG. 21(*a*), and it is possible to provide straight ink groove 303*a*. Since the straight flow path can be manufactured easily, and it has no crooked portion, air bubbles easily escape and they do not stay in ink chamber A.

In the conventional shear deformation ink jet head, ink has to be supplied through opening section 421 provided on top plate 304 because a rear end of an ink flow path is closed as shown in FIG. 21(*b*), but air bubbles stay at that portion and hardly escape because the ink path is crooked at that portion, which is a drawback. In the present embodiment, on the other hand, air bubbles easily escape from the ink flow path, and there is no fear that air bubbles stay in the ink flow path. Namely, if air bubbles enter the ink flow path, pressure applied on ink is absorbed by air bubbles because of jetting, which makes jetting impossible.

FIG. 22 is a sectional view of an ink jet head. FIG. 22(*a*) shows ink jet head 301 of the present embodiment, wherein electrodes 303*a* provided on both walls 302*b* which form ink chamber A are connected each other by signal lines 320, and electrodes 303*b* provided on both walls 302*b* which form air chamber B are connected to ground 321.

Due to the structure wherein ink chambers A and air chambers B are formed alternately as stated above, and electrodes 303*a* provided on both walls 302*b* which form ink chamber A are connected by a connection electrode to be connected to signal line 320, and electrodes 303*b* provided on both walls 302*b* which form air chamber B are connected by a connection electrode to be grounded, electrode formation and signal connection are simple, which is advantageous to attain high density, compared with a technology disclosed in TOKKAIHEI No. 7-132589 shown in FIG. 22(*b*) wherein electrodes are made separately between ink chamber A1 and air chamber B1, and a communicating line connecting between air chamber B1 and next air chamber B1 is provided in a way that the communicating line bypasses ink chamber A1.

FIG. 23 is a diagram showing a method of forming an electrode for an ink jet head. Protection film 330 is provided on the top portion of each groove 302*a* on the head base board 302 as shown in FIG. 23(*a*), then, metal which forms an electrode is evaporated from evaporation source 331 located on a plane which forms a fixed angle θ1 with an extended plane of the groove wall so that the metal 332 may be deposited up to the fixed depth of the groove wall as shown in FIG. 23(*b*), and then, the protection film 330 is removed after the deposition of the metal to form electrodes 303*a* and 303*b* as shown in FIG. 23(*c*). It is possible to form electrodes 303*a* and 303*b* simply on the groove wall, by evaporating metal which forms an electrode from evaporation source 331 located on a plane which forms a fixed angle θ1 with an extended plane of the groove wall to deposit the metal up to the fixed depth of the groove wall, and by removing the protection film after the deposition of the metal. Metal for an electrode to be used includes gold, silver, aluminum, palladium, nickel, tantalum and titanium, and among them, gold and aluminum is especially preferable from the viewpoint of electric characteristics, corrosion resistance and easy processing.

Figure 24:
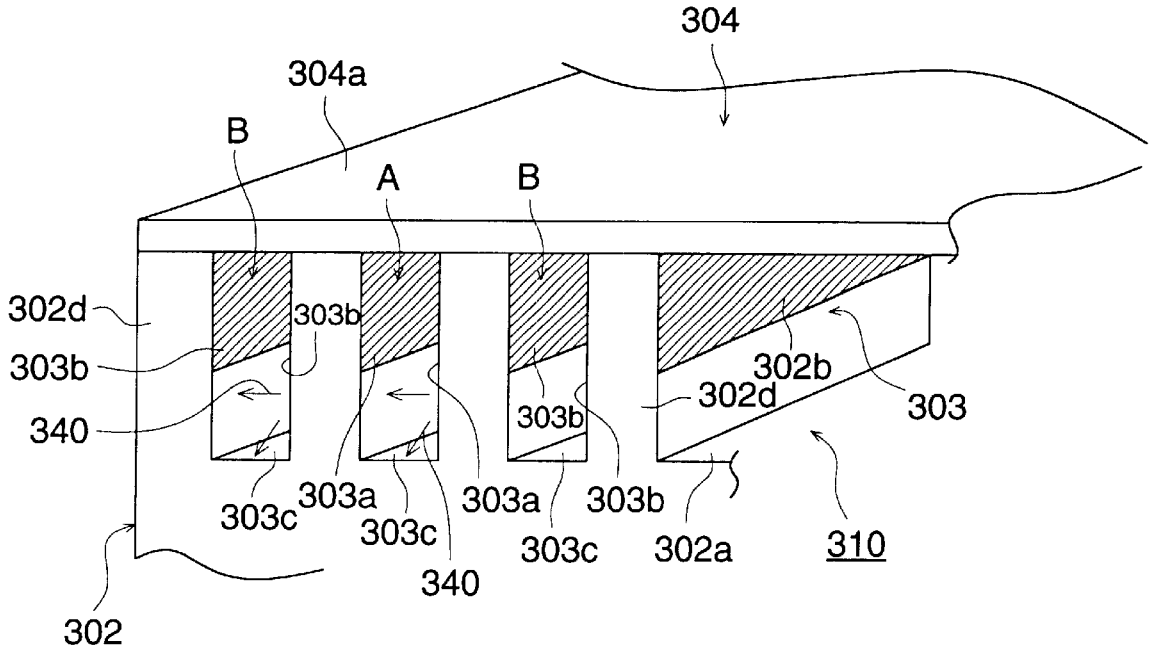
FIG. 24 is a diagram showing how an electrode of an ink jet head is formed.

FIG. 24 is a diagram showing formation of a connection electrode which connects electrodes formed separately on a left wall and a right wall of an ink chamber and an air chamber, each other. Ink supply side end portion 302*d* of head main body 310 where cover base board 304 is cemented with head base board 302 and cover base board top surface 304*a* are masked by photosensitive resin layers, and metal which forms an electrode is evaporated from an evaporation source 340 located on a plane which forms an acute angle with an extended plane of the groove bottom wall toward the cover base board so that connection electrode 303*c* which communicates with the electrode provided on each of both walls inside each groove may be formed, and it is possible to form simply connection electrode 303*c* which communicates with electrodes 303*a* and 303*b* provided on both walls inside each groove.

Then, a poly-p-xylylene (pariren) film is coated on the plane including the electrodes 303*a* and 303*b* provided on both walls inside each groove and connection electrode 303*c* so that the electrodes 303*a* and 303*b* and the connection electrode 303*c* may be insulated. Due to the coating of pariren, the electrodes 303*a* and 303*b* and the connection electrode 303*c* can be insulated firmly.

In shearing mode type ink jet head 301, head structure is simple because head base board 302 representing a piezoelectric element is a piezoelectric ceramic, and a vibration body and ink chamber A are formed solidly. In addition, ink chamber A is not damaged by ink and strength of the ink chamber A is high, compared with a thermal head wherein ink chamber A is formed by photosensitive resin or the like, because the ink chamber A is formed by piezoelectric ceramic.

Ink jet head 301 employing a piezoelectric element is usually composed of a piezoelectric element, a vibration plate and an ink chamber, and each ink chamber has an independent piezoelectric element and vibration plate, and vibration of the piezoelectric element is propagated to the ink chamber through a thin vibration plate to jet ink. Therefore, head structure is complicated, and it is difficult to manufacture, which is not suitable for high density. In addition, since the vibration plate and ink chamber are weak, they are corroded and dissolved by ink, and are destroyed easily by external force.

In ink jet head 301 of the present embodiment, ink chamber A is formed by ceramic piezoelectric element, and walls of the ink chamber A are subjected to shear deformation to jet ink. Therefore, a vibration section and ink chamber A can be formed solidly, thus, the structure is extremely simple, strength is high, and manufacturing is easy, which is suitable for high density. However, since walls forming ink chamber A are deformed, if ink chambers are provided to adjoin each other, when ink is jetted from a certain ink chamber, pressure is applied also on ink chambers on both sides of the ink chamber, and ink in each of them vibrates, thus, it is not possible for the adjoining ink chambers to jet ink simultaneously.

Further, when ink is jetted from a certain ink chamber, its influence is given not only to adjoining ink chambers on both sides of the ink chamber, but also to the next adjoining ink chambers and further to the next adjoining ink chambers, and pressure on ink in the ink chamber varies, thereby, ink drops can be jetted from these ink chambers until the variation of pressure on ink is eliminated. When ink drops are jetted before the variation of pressure on ink in the ink chamber is attenuated sufficiently, sizes of ink drops vary, and air is inhaled through an orifice, resulting in improper jetting and sharp reduction of image quality of prints.

A cross talk means that an influence of jetting ink is given from one ink chamber to other ink chambers, and ink jet head 301 employing a piezoelectric element is simple in structure, strong in strength, easy to be manufactured, and is suitable for high density, but it has a great cross talk, and high frequency driving is impossible, which is a drawback.

To overcome this drawback, every other ink chamber is divided into two groups of A and B to jet alternately, as in TOKKOHYO 6-6375, for example, or every third ink chamber is divided into three groups of A, B and C to jet on a time-sharing basis, to prevent the cross talk. However, this has a drawback that a cross talk is great and driving frequency is low, compared with a head wherein each ink chamber has an independent piezoelectric element and a vibration plate, because walls forming an ink chamber are subjected to shear deformation.

In the present embodiment of the invention, on the other hand, plural ink chambers A and air chambers B are formed alternatively on head main body 310 by partitioning with walls, and thereby, an influence of deformation of wall 302*a* is blocked by air chamber B, and is not given to other ink chambers A, thus, all ink chambers A can jet simultaneously, and can be driven at high frequency. Since air is smaller than water in terms of density, air chamber B can block efficiently the vibration of wall 302*a* caused by jetting, and further, a straight ink flow path for supplying ink from ink guiding inlet 306*a* to orifice 305*a* is formed on ink chamber A, and air bubbles do not stay in the ink flow path because no crooked portion exists in the ink flow path. In this simple structure, air bubbles do not stay and stable and high speed jetting of ink is possible.

In the conventional shearing mode head, an orifice is made by an excimer laser beam on a resin plate such as, for example, polyimide resin plate, then, adhesive agents are coated on a wall on the end portion of an ink flow path, and then, a nozzle plate (polyimide resin) is cemented through cementing, heating and hardening, and a minute orifice (entrance diameter is about 100 $\mu$ and exit diameter is 40–50 $\mu$) needs to be positioned accurately at the center of the ink chamber (order of±several microns). Further, since the number of orifices ranges from the minimum of 30 to the maximum of 300, it is difficult to position all holes accurately. Since adhesive agents are coated on the end portion of the ink chamber, it is needed to position at a stretch. Further, if heating is conducted after cementing, viscosity of adhesive agents is reduced sharply, thus, there is a fear that adhesive agents flow out and enter the orifice. After cementing, heating is conducted for one hour to about 100° C. to accelerate hardening, but a nozzle plate (polyimide resin) and PZT are different from each other in terms of thermal expansion coefficient. Therefore, even when positioning is conducted accurately in room temperature, the positions are shifted if heating is conducted.

If the position of an orifice is shifted by several microns, an image is affected and image quality is sharply lowered. It is possible to make an orifice at an accurate position, if the orifice is made by an excimer laser beam through a straight ink chamber on a nozzle plate (polyimide resin) on which an orifice is not made, after the nozzle plate is cemented, heated and hardened. Further, no adhesive agent flows in.

Further, when an orifice is made by an excimer laser beam from the ink chamber side, a hole diameter on the inlet portion for the laser beam is greater than that on the outlet side. Therefore, an orifice wherein jetting resistance is low and no air bubbles are inhaled. For making an orifice after cementing a nozzle plate (polyimide resin), it is necessary to irradiate a laser beam from the ink chamber side, but, this can not be done on the conventional type wherein a groove at the rear end portion is shallow.

As a piezoelectric element used for ink jet head 301 of the present embodiment, lead titanate and zirconate (trade name is PZT) is preferable because its filling density is high, piezoelectric constant is great, and it can be processed easily. When the temperature of PZT is lowered after the PZT is formed through baking, its crystalline structure is changed suddenly, an atom is shifted, and the PZT becomes a lump of small crystals in a shape of a dipole wherein one side is positive and the opposite side is negative spontaneous polarization of this kind is random in terms of direction, and polarity is offset each other. Therefore, further polarization processing is necessary.

In the polarization processing, a thin plate of PZT is sandwiched by electrodes and is dipped in a silicone oil, and high electric field of about 10–35 kv/cm is applied thereon for polarization. When voltage is impressed on the polarized PZT in the direction perpendicular to the polarization direction as shown in FIG. 8, walls are subjected to shear deformation in a doglegged shape in the oblique direction under the piezoelectric sliding effect, and a volume of the ink chamber is expanded, thus, ink is supplied to ink chamber A from ink supply section 307 as shown in FIG. 18–FIG. 20. In this case, negative pressure wave is caused in the ink chamber to be propagated through ink, and after the lapse of time L/v (L: length of an ink chamber, v: the speed of sound), the pressure wave arrives at the end portion of the ink chamber to be reflected thereon, and then, it is reversed in terms of phase to become a positive pressure wave. In this case, when voltage impressed on the electrode is grounded, deformation of the walls is eliminated and a volume of the ink chamber is reduced, thereby, pressure is impressed on ink. The reversed positive pressure wave and pressure from the walls are put together, and high pressure is impressed on ink, thus, ink is jetted from orifice 305*a*. When an amount of deformation of the piezoelectric element is greater, the pressure applied on ink is higher, the jetting speed of an ink drop is higher, the straightness of jetting is higher, and resolution of an image is improved.

Figure 25:
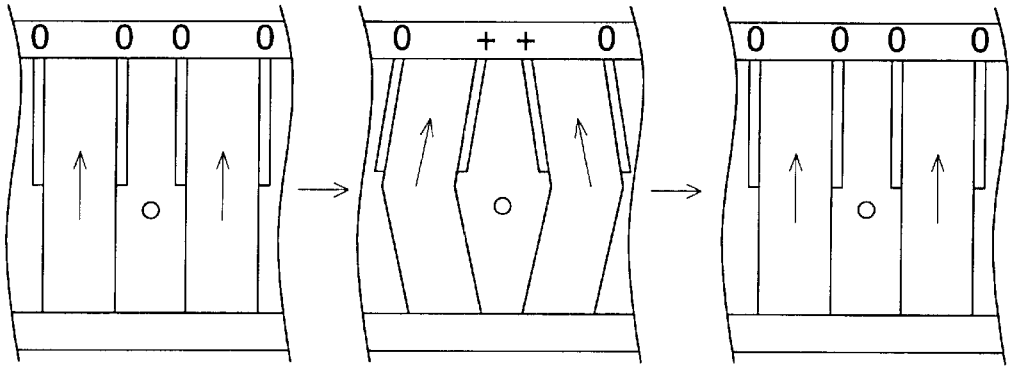
FIGS. 25(*a*) and 25(*b*) are diagrams showing how a piezoelectric element is deformed.
Figure 25:
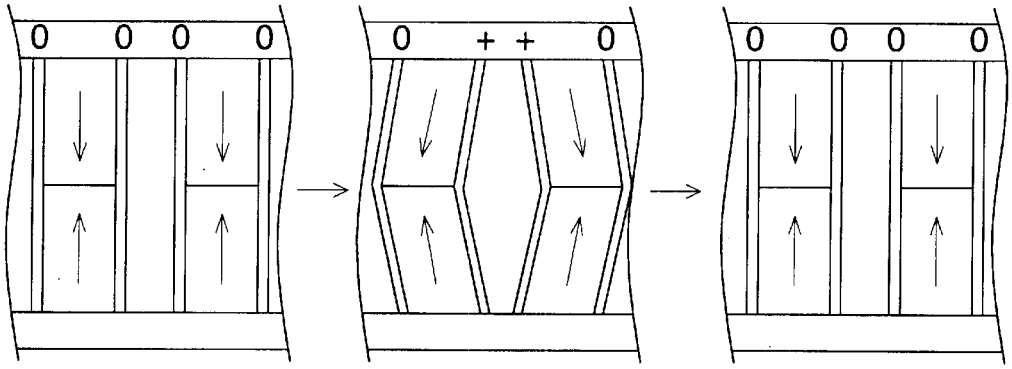

To make the deformation of the piezoelectric element to be greater, it is more preferable to use two PZTs by cementing them so that their polarization directions may be opposite to each other, by providing electrodes on their entire surfaces, and by impressing voltage on the two PZTs as shown in FIG. 25(*b*), than to use one PZT to provide electrodes on the upper half of the PZT to deform the upper half as shown in FIG. 25(*a*). This is disclosed as a chevron type in U.S. Pat. Nos. 4,879,568, 4,992,808, 5,003,679 and 5,028,936.

When two PZTs are cemented and used so that their polarization directions may be opposite to each other, an amount of shear deformation is doubled compared with the case of one PZT, and thereby, a half of driving voltage is enough to obtain the same amount of deformation. On the polarized PZT, groove 302*a* is formed by a diamond grinder.

Grooves each being 1–5 mm in length, 300–500 $\mu$ in depth, and 50–100 $\mu$ approximately are provided at the density which is twice that of printing. For example, when printing at 180 DPI is desired, the grooves are provided at an interval of 25400/360=70 $\mu$.

It is preferable that a width of a groove of air chamber B is narrower than that of a groove of ink chamber A, because it is possible to raise nozzle density. However, it is possible to change a width of the groove of the air chamber, when it is necessary. It is preferable that the groove of ink chamber A is made to be shallower toward the orifice side. This is because of that the diameter of the orifice at the inlet side is about 100 $\mu$, and when this portion has a step, air bubbles stay there and they hardly escape. A depth of the groove on the orifice side is preferably a half of that on the ink guiding hole side.

In providing electrodes on both walls of the groove, a method to make an electrode in the case where the wall is formed by one PZT is different from that to make an electrode in the case where the wall is formed by cementing two PZTs polarized to be opposite in direction. Further, a method to make an electrode in the case where voltage is applied on an electrode in the ink chamber is different from that in the case where an electrode in the ink chamber is grounded.

There will be explained an occasion where the wall is formed by one PZT and voltage is impressed on an electrode in the ink chamber. Since the upper portion and the lower portion of the wall are fixed, an electrode is formed on a half of the wall, preferably, on the upper half of the wall, and the upper half of the wall is subjected to shear deformation.

In the method to form an electrode on the upper half of the wall, metal is usually deposited in the oblique direction. When depositing from the upper portion of the groove obliquely by making the surface of the piezoelectric base board on which a groove is formed is made to face an evaporation source, and by inclining a head base board obliquely so that the lower half of the groove may be interrupted by the wall, an electrode is formed only on the upper half of the groove. Then, when depositing is conducted after rotating the head base board by 180 degrees, an electrode is formed also on the upper half on the opposite side of the wall. In this case, the electrode on the groove is accidentally connected with an electrode on an adjoining groove, because depositing is also conducted on a bank portion between both grooves. It is therefore necessary to mask the bank portion with a dry film in advance, and to remove the mask after depositing. As a material of the electrode, gold, aluminum, tantalum, and titanium are preferable from the viewpoint of electric characteristics, corrosion resistance and easy processing.

Further, it is necessary to connect electrodes formed on both walls of a groove, and therefore, connection electrodes are formed on both walls and a bottom at inlet section of the groove by depositing obliquely in the two directions by making the inlet surface of the groove to face the evaporation source. In addition, wiring connected with PPC is formed on the reverse side of the groove through depositing.

Since the portions facing the evaporation source are all deposited, a portion where an electrode must not be formed needs to be covered by a dry film in advance to be exposed, developed and masked. An electrode in the ink chamber is connected to the signal wire, and an electrode in the air chamber is grounded. When forming walls of the ink chamber and the air chamber with two PZTs, the entire surface of the wall needs to be provided with electrode. Therefore, plating, in particular, electroless plating, for example, Ni—P plating is more preferable than depositing. Even in this case, a portion which does not need an electrode is masked by a dry film.

Since voltage is applied on an electrode in the ink chamber, it is necessary to insulate, because if conductive water-color ink is used, jetting becomes impossible due to a short circuit, or ink is electrolyzed and air bubbles are generated, or the electrode is corroded.

A film made of polyparaxylylic resin (hereinafter referred to as a pariren film) is preferable as an insulation film. This pariren film is formed through a CVD (chemical vapor deposition) method wherein solid diparaxylylic diner is a deposition source. Namely, stable diradicalparaxylylic dimer generated by vaporization and thermal decomposition of diparaxylylic dimer is deposited on a head base body to be subjected to polymerization reaction to form a film.

A chemical deposition apparatus for forming a pariren film is composed of a sublimation furnace, a thermal decomposition furnace and a casting base furnace. These furnaces are connected by piping forming a path for gas. A degree of vacuum of the deposition apparatus is kept at $10^{-3}$–1 torr. The inside of the sublimation furnace is kept at 100–200° C., the inside of the thermal decomposition furnace is kept at 450–700° C., and the inside of a casting base tank is kept at room temperature.

Inside the sublimation furnace, evaporation of diparaxylylene is conducted. Inside the casting base tank, there is provided a rotary stand which rotates at about 10 rpm. Diparaxylylene radical generated in the thermal decomposition furnace is deposited on a head base body placed in the casting base tank and is subjected to vapor phase polymerization simultaneously, to form paraxylylic film with high molecular weight. It is preferable that the thickness of pariren film is 1–10 $\mu$, in particular, 3–5 $\mu$. Diparaxylylene representing a raw material is made to evaporate in the sublimation furnace at 190° C., then evaporated diparaxylylene is subjected to thermal decomposition in the thermal decomposition furnace at 680° C. to generate diparaxylylene radical which is subjected to base-casting in the base casting tank decompressed to 1 torr for four hours to be formed to 3 $\mu$-thick pariren film. Pariren film can be formed uniformly even on the head base board in a complicated shape.

The pariren film is extremely hydrophobic, and when pariren film is provided in the ink flow path in the narrow ink chamber, it expels water type ink, and water type ink can not enter the flow path. When air bubbles are mixed in the ink flow path, the air bubbles stick to the hydrophobic surface because they are hydrophobic, and they stick and hardly escape. Therefore, it is necessary to treat the surface of pariren film with oxygen plasma to make it to be hydrophilic.

An example of the plasma apparatus is a reaction apparatus of a parallel plate type wherein raw material gas is oxygen, gas flow rate is 50 SCCM, pressure is 10 Pa, discharge method is 13.56 Mhz and output 200 W, and processing time is 2 minutes. Due to processing by this apparatus, the pariren film is etched by about 0.5 $\mu$, and the surface is activated. As a result, a contact angle of water is reduced from 85° to 10°, and wettability is sharply improved.

In the plasma processing, even when a hydrophilic group is formed on the pariren surface, if it is left in the air, hydrophobic groups emerge gradually on the surface because air is hydrophobic. To prevent this, hydrophilic thin plate such as $SiO_2$ or $Si_3N_4$ may be formed on the plasma processing surface, or water-soluble high polymer, polyethyleneimine or polyacrylic acid may be graft-polymerized on the pariren surface.

Figure 26:
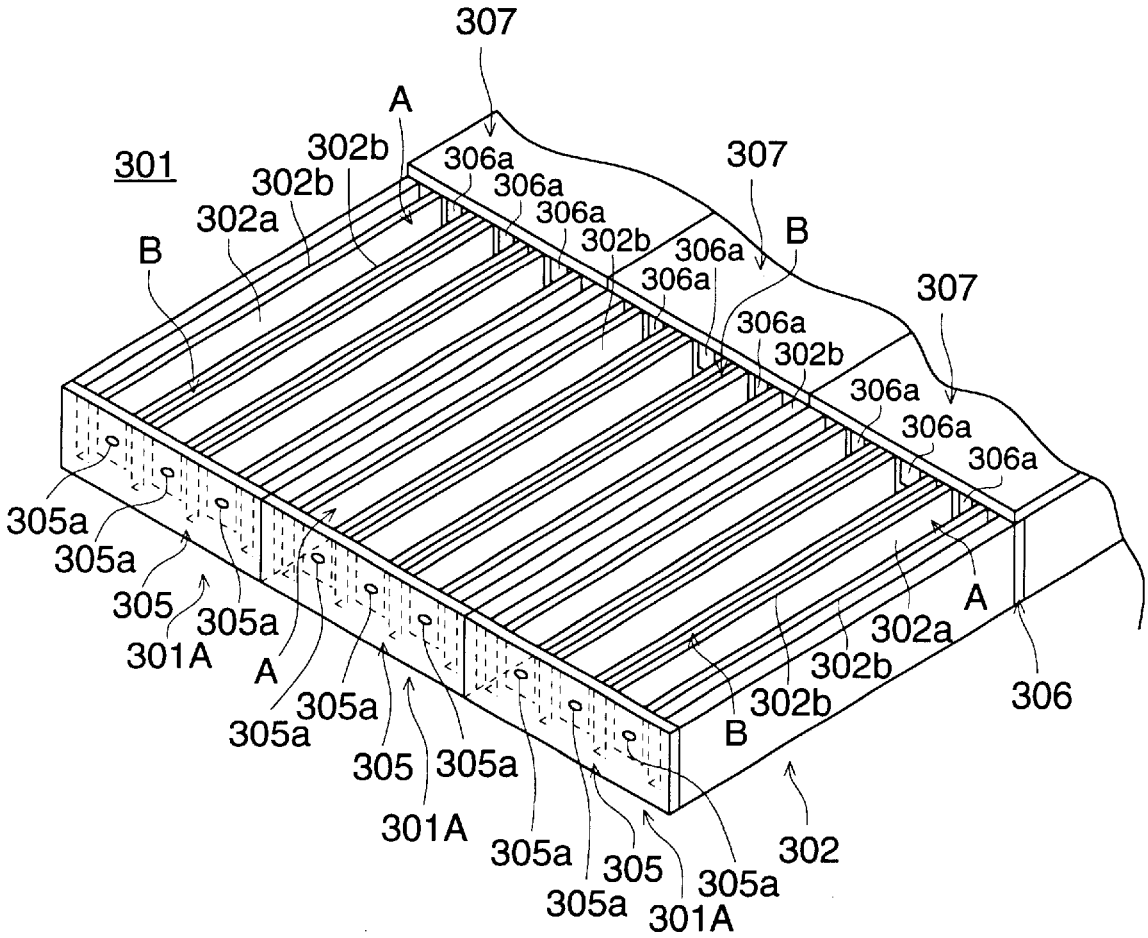
FIG. 26 is a perspective view of an ink jet head constituted by connecting plural head units.

Further, ink jet head 301 may be structured by connecting plural head units 3-1A as shown in FIG. 26, and this head unit 3-1A is constituted in a way that plural ink chambers and air chambers are formed alternatively on a head main body representing a polarized piezoelectric element by partitioning them with walls, and voltage is impressed on an electrode on the head main body to make walls partitioning ink chambers to be subjected to shear deformation so that ink may be jetted from an orifice. Due to this structure wherein plural head units 301A are connected, a highly accurate line head of a long type which is low in cost can be obtained, and thereby, it is possible to record images with high image quality at high speed.

An ink jet head usually has 64–300 ink chambers, and it prints while moving a head having a lateral width of 2–3 cm in the lateral direction of a recording medium. Therefore, its printing speed is slower than that of a laser printer, and it is desired to be higher in speed.

Accordingly, a head having a length which is the same as that of a recording medium, for example, a recording medium in A3 size is desired. With regard to the head of the invention, it is possible to make a short head having a lateral width of about 2 cm and having 4 ink chambers, for example, and thereby to make a line head by connecting the plural short heads, for example, 10 short heads in the lateral direction. TOKKAIHEI No. 5-64893 discloses a shear mode line head wherein walls are formed by PZT and resins. Short PZT plates are arranged in order and are cemented on the long resin plate, and a large number of grooves are formed, thus, a line head is made.

In this method, it is difficult to manufacture the heads because a head is condemned as a defective head if even only one of ink chambers in quantity of several hundreds–1000 in the head is defective.

In the present invention, short heads each having about 64 ink chambers are made, they are tested, and the heads having passed the test are assembled, thus, reliability is greatly improved. TOKKAIHEI No. 2-11333 discloses a line head wherein short shear mode heads are stacked longitudinally and laterally, but a shape of an ink flow path, an electrode forming method and a signal connection method are not disclosed.

What is claimed is:

1. A method of manufacturing an ink jet head in which an ink is jetted from a nozzle hole by applying an electric voltage to an electrode so as to deform ink chambers divided by a partition wall, comprising:

providing plural piezoelectric base plates given polarization side by side on a first non-piezoelectric base plate;

making plural grooves for the ink chambers on the plural piezoelectric base plates and at connecting portions through the plural piezoelectric base plates placed side by side, where each edge of the plural piezoelectric base plates are side by side and come to face each other at the connecting portions, the edges of the plural piezoelectric base plates being substantially vertical to the first non-piezoelectric base plate; and mounting a second non-piezoelectric base plate on the plural piezoelectric base plates so as to cover the plural grooves so that the ink chambers divided by the partition.

2. A method of manufacturing an ink jet head in which an ink is jetted from a nozzle hole by applying an electric voltage to an electrode so as to deform ink chambers divided by a partition wall, comprising:

providing plural piezoelectric base plates on a first non-piezoelectric base plate in such a manner that each of the plural piezoelectric base plates forms two lamination piezoelectric layers and the plural piezoelectric base plates are arranged side by side on the first non-piezoelectric base plate, wherein polarization directions of the two lamination piezoelectric layers are opposite to each other;

making plural grooves for the ink chambers on the plural piezoelectric base plates and at connecting portions through the plural piezoelectric base plates placed side by side, where each edge of the plural piezoelectric base plates side by side and come to face each other at the connecting portions, the edges of the plural piezoelectric base plates being substantially vertical to the first non-piezoelectric base plate; and mounting a second non-piezoelectric base plate on the plural piezoelectric base plates so as to cover the plural grooves so that the ink chambers divided by the partition wall are formed.

3. The method of claim 2, wherein the plural piezoelectric base are made of a non-metallic material.

4. The method of claim 3, wherein the non-metallic material is made of at least one selected from the group consisting of alumina, aluminum nitride, zirconia, silicon, silicon nitride, silicon carbide, and quartz.

5. The method of claim 2, wherein a surface roughness of surfaces by which the first and second non-piezoelectric base plates and the plural piezoelectric base plates are pasted with each other is not larger than 1.0 $\mu$m.

6. The method of claim 5, further comprising subjecting surfaces of the first and second non-piezoelectric base plates and the plural piezoelectric base plates to a plasma treatment or a U.V. treatment.

7. The method of claim 2, wherein a surface roughness of surfaces by which the two lamination piezoelectric layers of each of the piezoelectric base plates are pasted with each other is not larger than 1.0 $\mu$m.

8. The method of claim 7, further comprising subjecting surfaces to be pasted to a plasma treatment or a U.V. treatment.

9. A method of manufacturing an ink jet printer provided with an ink jet head to jet ink from a nozzle hole by applying an electric voltage to an electrode so as to deform ink chambers divided by a partition wall, comprising:

providing plural piezoelectric base plates given polarization side by side on a first non-piezoelectric base plate;

making plural grooves for the ink chambers on the plural piezoelectric base plates and at connecting portions through the plural piezoelectric base plates placed side by side, where each edge of the plural piezoelectric base plates are side by side and come to face each other at the connecting portions, the edges of the plural piezoelectric base plates being substantially vertical to the first non-piezoelectric base plate; and mounting a second non-piezoelectric base plate on the plural piezoelectric base plates so as to cover the plural grooves so that the ink chambers divided by the partition wall are formed.

10. A method of manufacturing an ink jet printer provided with an ink jet head to jet ink from a nozzle hole by applying an electric voltage to an electrode so as to deform ink chambers divided by a partition wall, comprising:

providing plural piezoelectric base plates on a first non-piezoelectric base plate in such a manner that each of the plural piezoelectric base plates forms two lamination piezoelectric layers and the plural piezoelectric base plates are arranged side by side on the first non-piezoelectric base plate, wherein polarization directions of the two lamination piezoelectric layers are opposite to each other;

making plural grooves for the ink chambers on the plural piezoelectric base plates and at connecting portions through the plural piezoelectric base plates placed side by side, where each edge of the plural piezoelectric base plates side by side and come to face each other at the connecting portions, the edges of the plural piezoelectric base plates being substantially vertical to the first non-piezoelectric base plate; and mounting a second non-piezoelectric base plate on the plural piezoelectric base plates so as to cover the plural grooves so that the ink chambers divided by the partition wall are formed.

* * * * *